US009835970B2

(12) United States Patent
Shibuya et al.

(10) Patent No.: US 9,835,970 B2
(45) **Date of Patent: *Dec. 5, 2017**

(54) IMAGE FORMING APPARATUS WITH PRE-EXPOSURE MEMBER

(71) Applicant: CANON KABUSHIKI KAISHA, Tokyo (JP)

(72) Inventors: Kenichi Shibuya, Toride (JP); Sumito Tanaka, Tokyo (JP); Shota Soda, Abiko (JP); Jun Tomine, Abiko (JP); Hiroyuki Eda, Moriya (JP); Hirohisa Nakajima, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/185,641

(22) Filed: Jun. 17, 2016

(65) Prior Publication Data

US 2016/0291499 A1 Oct. 6, 2016

Related U.S. Application Data

(63) Continuation of application No. PCT/JP2014/084770, filed on Dec. 19, 2014.

(30) Foreign Application Priority Data

Dec. 20, 2013 (JP) ..... 2013-263296

(51) Int. Cl.

| | |
|---|---|
| ***G03G 15/02*** | (2006.01) |
| ***G03G 15/01*** | (2006.01) |
| ***G03G 21/08*** | (2006.01) |

(52) U.S. Cl.
CPC ..... *G03G 15/0275* (2013.01); *G03G 15/0189* (2013.01); *G03G 21/08* (2013.01); *G03G 2215/0129* (2013.01)

(58) Field of Classification Search
None
See application file for complete search history.

(56) References Cited

U.S. PATENT DOCUMENTS

| | | | | |
|---|---|---|---|---|
| 6,738,588 | B2 | 5/2004 | Yokomori et al. | |
| 9,417,566 | B2 | 8/2016 | Shibuya | |
| 2006/0274628 | A1 * | 12/2006 | Tanaka | G03G 15/1605 369/100 |

FOREIGN PATENT DOCUMENTS

| | | | |
|---|---|---|---|
| JP | 09-185193 | A | 7/1997 |
| JP | 2002-049167 | A | 2/2002 |
| JP | 2002-189400 | A | 7/2002 |
| JP | 2004-341420 | A | 12/2004 |
| JP | 2007-127711 | A | 5/2007 |
| JP | 2008-026791 | A | 2/2008 |
| JP | 2008310311 | A * | 12/2008 |

OTHER PUBLICATIONS

JP_2008310311_A_T Machine Translation JP Dec. 2008 Gondo.*

* cited by examiner

*Primary Examiner* — Victor Verbitsky
(74) *Attorney, Agent, or Firm* — Fitzpatrick, Cella, Harper & Scinto

(57) ABSTRACT

In an image forming apparatus including a plurality of image forming stations, on the basis of a density of a toner image formed in an upstream image forming station, an operation of a pre-exposure device in a downstream image forming station is controlled.

11 Claims, 18 Drawing Sheets

IMAGE FORMING APPARATUS WITH PRE-EXPOSURE MEMBER

TECHNICAL FIELD

The present invention relates to an image forming apparatus. As this image forming apparatus, for example, it is possible to cite image forming apparatuses such as a copying machine, a printer, a facsimile (FAX) machine, and a multi-function machine having a plurality of functions of these machines.

BACKGROUND ART

In recent years, a so-called tandem type image forming apparatus including a plurality (four) of image forming stations has been proposed. Such an image forming apparatus is capable of quickly forming a color image using an electrophotographic process, and therefore, receives attention.

In each image forming station, around a photosensitive member, a charging device (charging means), an exposure device (exposure means) and developing device (developing means) are provided. Further, toner images formed at the respective image forming stations are successively transferred superposedly onto an intermediary transfer member (image receiving member), and thereafter, are transferred onto a recording material altogether.

Here, as a type of the charging device, two types, i.e., an "AC charging type" for (electrically) charging the photosensitive member by applying a superposed voltage of an AC voltage and a DC voltage and a "DC charging type" for (electrically) charging the photosensitive member by applying only the DC voltage have been known. The "AC charging type" is advantageous in that a surface of the photosensitive member can be uniformly charged compared with the "DC charging type", but a discharge amount to the photosensitive member is large and therefore the photosensitive member tends to be liable to deteriorate. Further, an expensive AC voltage (power) source is needed. On the other hand, compared with the "AC charging type", in the "DC charging type", the photosensitive member does not readily deteriorate, but tends to be inferior in charging uniformity. That is, compared with the "DC charging type", the "AC charging type" is high in initial costs and running costs. In other words, compared with the "AC charging type", the "DC charging type" is advantageous in terms of the running costs and the initial costs.

Therefore, in the case where the "DC charging type" is intended to be employed, the following problems can generate.

Specifically, in an apparatus described in Japanese Laid-Open Patent Application 2002-189400, in order to lower a potential (residual potential) of the photosensitive member remaining after transfer to the neighborhood of 0 V, a device for optically discharging the photosensitive member, a so-called pre-exposure device (discharging means), is mounted. Thus, in the case where a method of discharging the photosensitive member by using the pre-exposure device is employed, in the charging device, the photosensitive member has to be charged from the neighborhood of 0 V to a desired potential (e.g., −700 V), and compared with the case where a discharging step by the pre-exposure device is not performed, a discharge current becomes large. That is, compared with the case where the discharging step by the pre-exposure device is not performed, the photosensitive member tends to be liable to deteriorate.

SUMMARY OF THE INVENTION

Problems to be Solved by the Invention

However, in the case where the discharging step by the pre-exposure device is not performed (there is an advantage such that promotion of deterioration of the photosensitive member can be suppressed), the photosensitive member only has a discharging effect by a transfer device. This discharging effect depends on a toner image formed in a preceding image forming station, i.e., an amount of a toner which is a resistor (electrical), and there can be the case where the photosensitive member goes to a subsequent charging step while the photosensitive member is little discharged.

For example, when each of toner images formed in first and second image forming stations has a maximum density (two color solid images), in transfer steps of third and fourth image forming stations, the photosensitive members little have the discharging effect. Resulting from this, there is a liability that a ghost image (defective image) generates on a subsequent image. That is, in the third and fourth stations, from their arrangement viewpoint, a density of a coming toner image tends to become high, so that there is a liability that the ghost image can generate.

On the other hand, in the case where the toner images formed in the first image forming station and the second image forming station have low densities, the above-described ghost image is to the extent that the ghost image is not recognized.

An object of the present invention is to provide an image forming apparatus capable of suppressing generation of image defect while suppressing a lowering in lifetime of a photosensitive member by a discharging means.

Another object will become apparent by reading the following detailed description while making reference to the attached drawings.

Means for Solving the Problems

A first invention is an image forming apparatus comprising: a first image forming station including a first photosensitive member, charging means configured to charge the first photosensitive member, first exposure means configured to expose the first photosensitive member charged by the first charging means to light on the basis of first image data, and first developing means configured to develop with a toner an electrostatic latent image formed on the first photosensitive member by the first exposure means; a second image forming station including a second photosensitive member, second charging means configured to charge the second photosensitive member by being supplied with only a DC voltage, second exposure means configured to expose the second photosensitive member charged by the second charging means to light, and second developing means configured to develop with a toner an electrostatic latent image formed on the second photosensitive member by the second exposure means; transfer means configured to electrostatically transfer superposedly a toner image formed on the first photosensitive member and a toner image formed on the second photosensitive member onto an image receiving member in this order; discharging means configured to optically discharge the second photosensitive member; and control means configured to control an operation of the discharging means depending on a density of the toner image formed in the first image forming station.

A second invention is an image forming apparatus comprising: a first image forming station including a first photosensitive member, first charging means configured to charge the first photosensitive member, first exposure means configured to expose the first photosensitive member charged by the first charging means to light on the basis of first image data, and first developing means configured to develop with a toner an electrostatic latent image formed on the first photosensitive member by the first exposure means; a second image forming station including a second photosensitive member, second charging means configured to charge the second photosensitive member, second exposure means configured to expose the second photosensitive member charged by the second charging means to light, and second developing means configured to develop with a toner an electrostatic latent image formed on the second photosensitive member by the second exposure means; a third image forming station including a first photosensitive member, third charging means configured to charge the third photosensitive member by being supplied with only a DC voltage, third exposure means configured to expose the third photosensitive member charged by the third charging means to light, and third developing means configured to develop with a toner an electrostatic latent image formed on the third photosensitive member by the third exposure means; a fourth image forming station including a fourth photosensitive member, fourth charging means configured to charge the fourth photosensitive member by being supplied with only a DC voltage, fourth exposure means configured to expose the fourth photosensitive member charged by the fourth charging means to light, and fourth developing means configured to develop with a toner an electrostatic latent image formed on the fourth photosensitive member by the fourth exposure means; transfer means configured to electrostatically transfer superposedly a toner image formed on the first photosensitive member, a toner image formed on the second photosensitive member and a toner image formed on the third photosensitive member onto an image receiving member in this order; first discharging means configured to optically discharge the third photosensitive member; second discharging means configured to optically discharge the fourth photosensitive member; and control means configured to control an operation of the first discharging means depending on densities of toner images formed in the first image forming station and the second image forming station and configured to control an operation of the second discharging means depending on densities of toner images formed in the first image forming station, the second image forming station and the third image forming station.

A third invention is an image forming apparatus comprising: a first image forming station including a first photosensitive member, charging means configured to charge the first photosensitive member, first exposure means configured to expose the first photosensitive member charged by the first charging means to light on the basis of first image data, and first developing means configured to develop with a toner an electrostatic latent image formed on the first photosensitive member by the first exposure means; a second image forming station including a second photosensitive member, second charging means configured to charge the second photosensitive member by being supplied with only a DC voltage, second exposure means configured to expose the second photosensitive member charged by the second charging means to light on the basis of second image data, and second developing means configured to develop with a toner an electrostatic latent image formed on the second photosensitive member by the second exposure means; transfer means configured to electrostatically transfer superposedly a toner image formed on the first photosensitive member and a toner image formed on the second photosensitive member onto an image receiving member in this order; discharging means configured to optically discharge the second photosensitive member; and control means configured to control an operation of the discharging means depending on the first image data.

A fourth invention is an image forming apparatus comprising: a first image forming station including a first photosensitive member, first charging means configured to charge the first photosensitive member, first exposure means configured to expose the first photosensitive member charged by the first charging means to light on the basis of first image data, and first developing means configured to develop with a toner an electrostatic latent image formed on the first photosensitive member by the first exposure means; a second image forming station including a second photosensitive member, second charging means configured to charge the second photosensitive member, second exposure means configured to expose the second photosensitive member charged by the second charging means to light on the basis of second image data, and second developing means configured to develop with a toner an electrostatic latent image formed on the second photosensitive member by the second exposure means; a third image forming station including a third photosensitive member, third charging means configured to charge the third photosensitive member by being supplied with only a DC voltage, third exposure means configured to expose the third photosensitive member charged by the third charging means to light on the basis of third image data, and third developing means configured to develop with a toner an electrostatic latent image formed on the third photosensitive member by the third exposure means; a fourth image forming station including a fourth photosensitive member, fourth charging means configured to charge the fourth photosensitive member by being supplied with only a DC voltage, fourth exposure means configured to expose the fourth photosensitive member charged by the fourth charging means to light on the basis of fourth image data, and fourth developing means configured to develop with a toner an electrostatic latent image formed on the fourth photosensitive member by the fourth exposure means; transfer means configured to electrostatically transfer superposedly a toner image formed on the first photosensitive member a toner image formed on the second photosensitive member, a toner image formed on the third photosensitive member and a toner image formed on the fourth photosensitive member onto an image receiving member in this order; first discharging means configured to optically discharge the third photosensitive member; second discharging means configured to optically discharge the fourth photosensitive member; and control means configured to control an operation of the first discharging means depending on the first image data and the second image data and configured to control an operation of the second discharging means depending on the first image data, the second image data and the third image data.

Effect of the Invention

According to the present invention, it is possible to suppress the generation of the image defect while suppressing the lowering in lifetime of the photosensitive member by the discharging means.

EMBODIMENTS FOR CARRYING OUT THE INVENTION

In the following, embodiments according to the present invention will be described based on the attached drawings.

Embodiment 1

Figure 4:
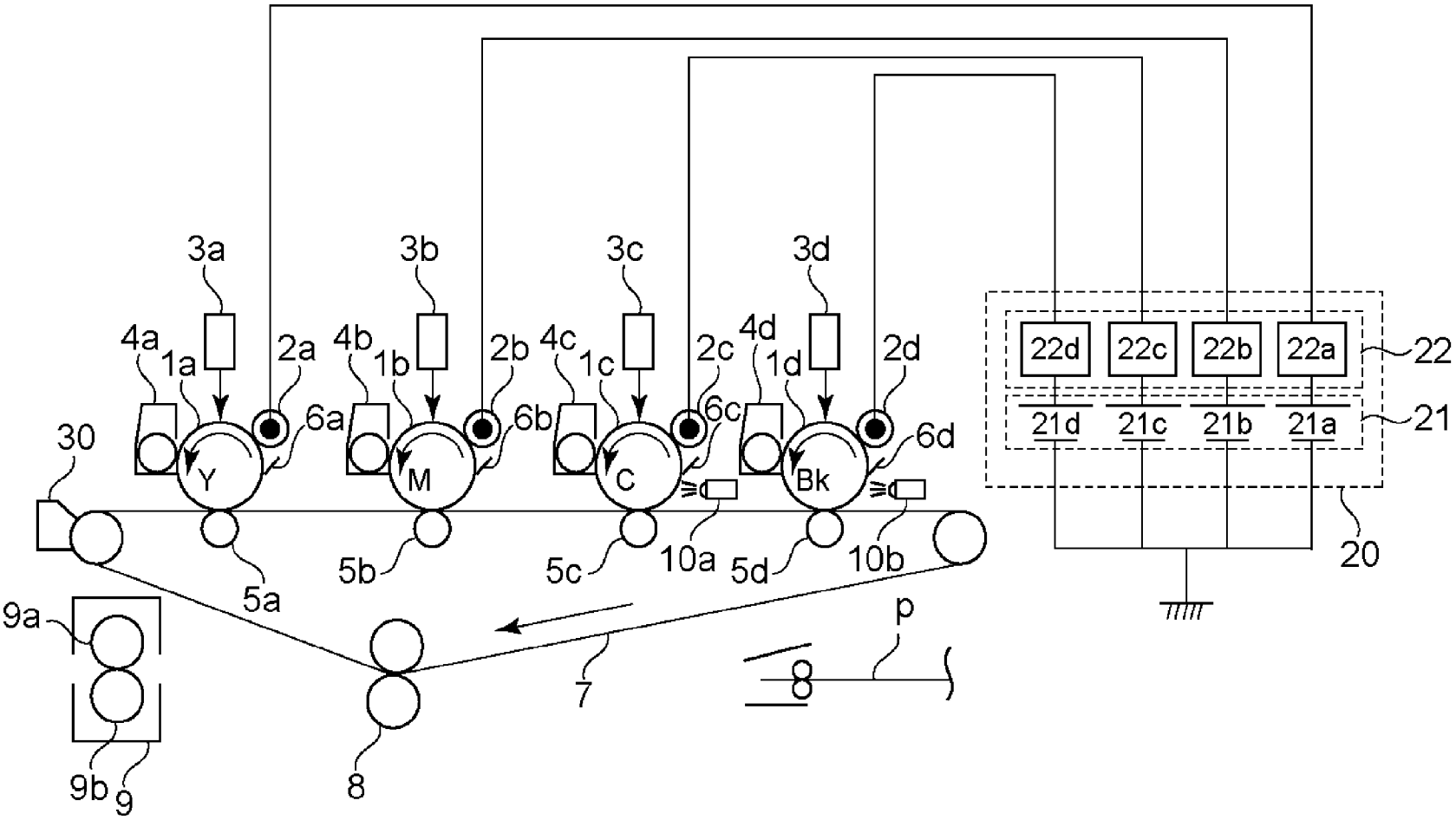
FIG. 4 is a schematic illustration of the image forming apparatus.

FIG. 4 is a schematic illustration showing an image forming apparatus according to the present invention. Incidentally, as the image forming apparatus, the present invention is applicable to image forming apparatuses such as copying machine, a printer, a FAX machine, and a multi-function machine having a plurality of functions of these machines, and in this embodiment, a full-color printer will be described as an example. First, details of image forming stations mounted in the image forming apparatus will be described.

(Image Forming Station)

The image forming apparatus includes a plurality (four) of image forming stations, and these four image forming stations are arranged with certain intervals along a movement direction of an intermediary transfer belt 7. The four image forming stations are image forming stations Y, M, C and Bk for colors of yellow (first), magenta (second), cyan (third) and black (fourth), respectively. Further, in the following, in the case where the colors are abbreviated as Y, M, C and Bk, these colors mean yellow, magenta, cyan and black, respectively.

In upstream image forming stations (first image forming stations) Y and M, photosensitive members (hereinafter also referred to as photosensitive drums) 1*a* and 1*b* are provided, respectively. Further, at peripheries of the respective photosensitive drums 1*a* and 1*b*, charging rollers 2*a* and 2*b* which are charging devices (charging means), exposure devices (exposure means) 3*a* and 3*b*, developing devices (developing means) 4*a* and 4*b*, and cleaning devices (cleaning means) 6*a* and 6*b* are provided.

In downstream image forming stations (second image forming stations) C and Bk, photosensitive members 1*c* and 1*d* are provided, respectively. Further, at peripheries of the respective photosensitive drums 1*c* and 1*d*, charging rollers 2*c* and 2*d* which are charging devices (charging means), exposure devices (exposure means) 3*c* and 3*d*, developing devices (developing means) 4*c* and 4*d*, and cleaning devices (cleaning means) 6*c* and 6*d* are provided.

(Photosensitive Member)

Figure 2:
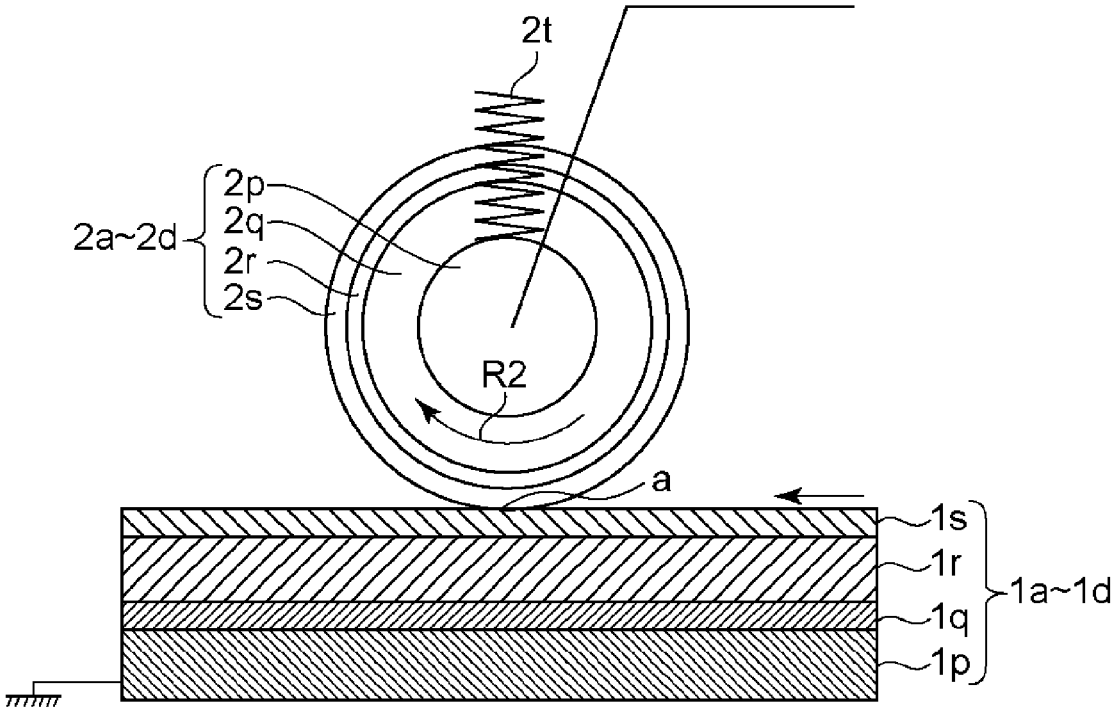
FIG. 2 is a view for illustrating a layer structure of a charging roller and a layer structure of a photosensitive member of an image forming apparatus.

The photosensitive drums 1*a*-1*d* are negatively chargeable organic photosensitive members (OPCs) of 30 mm in outer diameter in this embodiment, and are rotationally driven in arrow directions at a process speed of 210 mm/s in general by drive of a driving device (not shown). The photosensitive drums 1*a*-1*d* are, as shown in FIG. 2, constituted by applying, onto a surface of an aluminum-made cylinder (electroconductive drum substrate) 1*p*, 3 layers of an undercoat layer 1*q* for suppressing light interference and for improving an adhesive property to an upper layer, a photo-charge generation layer 1*r* and a charge transport layer is in this order from below.

(Charging Device)

The charging rollers 2*a*, 2*b*, 2*c* and 2*d* uniformly charge the surfaces of the photosensitive drums 1*a*, 1*b*, 1*c* and 1*d* by DC voltages applied from an unshown high-voltage circuit (charging bias voltage source). The charging rollers are provided so as to be contactable to the photosensitive drums. In this embodiment, the charging bias was −1300 V, and a potential (Vd; dark-portion potential (potential of a portion which is not subjected to image exposure)) was set so as to be −700 V at a developing position of the developing device by charging the photosensitive drum by electric discharge from the charging roller.

Specifically, the charging rollers 2*a*-2*d* charge the surfaces of the photosensitive drums 1*a*-1*d* to a predetermined potential by a charging bias (only a DC voltage) applied from the high-voltage circuit (charging bias voltage source) 20.

Specifically, to the charging rollers 2*a*-2*d*, a DC voltage of a negative polarity identical to the normal output polarity of the toner is applied, so that the surfaces of the photosensitive drums 1*a*-1*d* are charged to the negative polarity.

The bias (voltage) is generated by a combination of the high-voltage circuit 20, a DC voltage generating circuit 21 and DC voltage amplifying circuit 22. In FIG. 4, DC voltages applied to the charging rollers 2*a*-2*d* of the respective image forming stations are applied by the DC voltage generating circuits 21*a*, 21*b*, 21*c* and 21*d* in the DC voltage generating circuit 21. Further, magnitudes of DC voltage values thereof are adjusted by the DC voltage amplifying circuits 22*a*, 22*b*, 22*c* and 22*d* in the DC voltage amplifying circuit 22.

In this embodiment, as already described above, the DC charging type (in which the voltage applied to the charging device is only the DC voltage) which can generate a ghost image instead of suppression of costs was employed. Incidentally, as described above, when the AC charging type (in which the voltage applied to the charging device is the superposed voltage of the DC voltage and the AC voltage) is employed, a photosensitive drum residual potential smoothing effect is large, and therefore, although the ghost image does not readily generate, it constitutes a factor of an increase in cost.

Further, longitudinal lengths (lengths in which the charging rollers contact the photosensitive drums) of the charging rollers 2*a*-2*d* are 320 mm, and as shown in FIG. 2, each charging roller 2 has a 3-layer structure in which around a core metal 2*p* (supporting member), layers including an undercoat layer 2*q*, an intermediary layer 2*r* and a surface layer 2*s* are successively laminated from a lower side. The undercoat layer 2*q* is a foamed sponge layer for reducing a charging noise, and the surface layer 2*s* is a protective layer provided for preventing generation of leak even when the photosensitive drum has defects such a pinhole thereon.

Specifically, the specifications of the charging rollers 2*a*-2*d* in this embodiment are as follows:

Core metal 2*p*: round stainless rod of 6 mm in diameter

Undercoat layer 2*q*: foamed EPDM in which carbon black particles were dispersed, and which is 0.5 g/cm$^3$ in specific gravity, $10^2$-$10^9\Omega$ in volume resistivity, and 3.0 mm in thickness Intermediary layer 2*r*: NBR rubber in which carbon black particles were dispersed, and which is $10^2$-$10^5\Omega$ in volume resistivity, and 700 μm in thickness Surface layer 2*s*: fluorine-containing resin in which tin oxide particles and carbon black particles were dispersed, and which is $10^7$-$10^{10}\Omega$ in volume resistivity, 1.5 μm in surface roughness (10 point surface roughness Ra according to JIS), and 10 μm in thickness The charging rollers 2*a*-2*d* are urged toward a center of the photosensitive drums by urging springs 2*t*, so that the charging rollers are press-contacted to the surfaces of the photosensitive drums with a predetermined urging force at charging nips a, and are rotated by the rotational drive of the photosensitive drums in a direction of R2 in the figure.

In this embodiment, an entire volume resistivity, of the charging rollers 2*a*-2*d*, of $1.0\times10^5\Omega$ was employed.

(Exposure Device)

Figure 6:
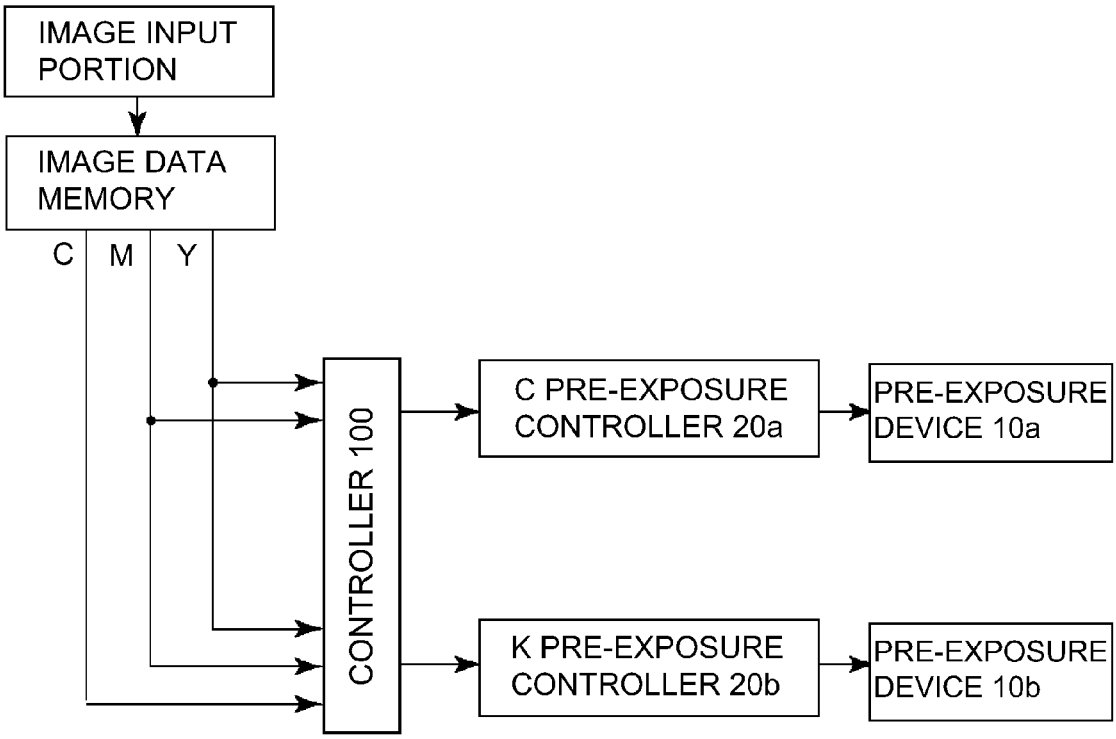
FIG. 6 is a block diagram showing a control system for controlling a pre-exposure device.

The exposure devices 3*a*, 3*b*, 3*c* and 3*d* are laser beam scanners using a semiconductor laser. The exposure devices 3*a*, 3*b*, 3*c* and 3*d* subject the surfaces of the photosensitive members, negatively charged uniformly, to image exposure on the basis of image information of an original inputted into an image input portion (FIG. 6). Specifically, the respective exposure devices 3*a*-3*d* output laser lights modulated correspondingly to the image information (image signals) of the original. These laser lights scan the surfaces of the photosensitive drums 1*a*-1*d*, so that electrostatic latent images are formed on the surfaces of the photosensitive members. In this embodiment, a potential (light-portion potential (VL)) at a position where the photosensitive drums 1*a*-1*d* are irradiated with the laser lights is −200 V.

Incidentally, the image forming apparatus (printer) is network-connected with a host computer (PC) via a LAN cable, the image information of the original is constituted so as to be inputted from this host computer into the image input portion.

(Developing Device)

In the developing devices (developing means) 4*a*, 4*b*, 4*c* and 4*d*, yellow, magenta, cyan and black toners, respectively, having a negative polarity as a normal charge polarity are accommodated.

To the developing devices 4*a*, 4*b*, 4*c* and 4*d*, a superposed developing bias of a DC voltage (Vdc) and with an AC voltage (Vac) is applied. Specifically, in this embodiment, the developing bias is 8 kHz in frequency of the AC voltage, is −550 V in the DC voltage, and is 1800 V in peak-to-peak voltage Vpp of the AC voltage. The charge polarity of the toner is the negative polarity, and therefore, the toner is deposited on the light portion of the photosensitive drums by the developing devices through a reverse development type.

(Transfer Device)

Further, at a lower portion of the respective image forming stations (respective photosensitive members), primary transfer rollers (transfer member) 5*a*, 5*b*, 5*c* and 5*d* which are transfer devices (transfer means) are provided opposed to the photosensitive drums via the intermediary transfer belt 7 which is the image receiving member. These primary transfer rollers 5*a*-5*d* have a constitution in which they rotate while pressing the intermediary transfer belt 7 toward the photosensitive members 1*a*-1*d*.

(Image Forming Sequence)

An image forming sequence at the respective image forming stations is performed through an electrophotographic process. Image forming processes in all the image forming stations are substantially the same, and therefore, the image forming process (sequence) of the Y image forming station will be described as a representative.

First, the surface of the photosensitive drum 1*a* is charged substantially uniformly to the negative potential by the charging roller 2*a*. At this time, to the charging roller 2*a*, only a DC voltage is applied. Next, on the basis of Y image data, the exposure device 3*a* subjects the photosensitive drum 1*a* to image exposure, so that the electrostatic image is formed on the photosensitive drum 1*a*. Thereafter, the electrostatic image on the photosensitive drum 1*a* is developed with the toner by the developing device 4*a*, so that the toner image is formed on the photosensitive drum 1*a*.

Thus, the color toner images formed on the photosensitive drums 1*a*, 1*b*, 1*c* and 1*d*, respectively, are electrostatically transferred in this order superposedly onto the intermediary transfer belt 7 which is the image receiving member (transfer receiving member) by the respective transfer rollers 5*a*-5*d*. A voltage (DC voltage) applied to each of the transfer rollers 5*a*-5*d* is a voltage of a positive polarity which is an opposite polarity to the normal charge polarity of the toner. That is, the polarity of the voltage applied to each of the transfer rollers 5*a*-5*d* is an opposite polarity to the polarity of the voltage applied to each of the charging rollers 2*a*-2*d*.

Further, the toner images for the four colors transferred superposedly on the intermediary transfer belt 7 are transferred altogether onto the recording material P, fed by a paper (sheet) feeding mechanism, by a secondary transfer roller 8 which is a transfer mechanism. At this time, to the secondary transfer roller 8, a DC voltage of the positive polarity is applied.

Thereafter, the recording material P separated from the secondary transfer roller 8 is subjected to a fixing process by a fixing device 9. Specifically, in a fixing nip roller 9*a* and a pressing roller 9*b*, a full-color toner image is heated and pressed, and is fixed on the recording material P. Thereafter, the recording material P is discharged to an outside of the image forming apparatus. Incidentally, the toner, on the intermediary transfer belt 7, which has not been completely transferred by the secondary transfer roller 8 is removed by a cleaner 30.

Figure 3:
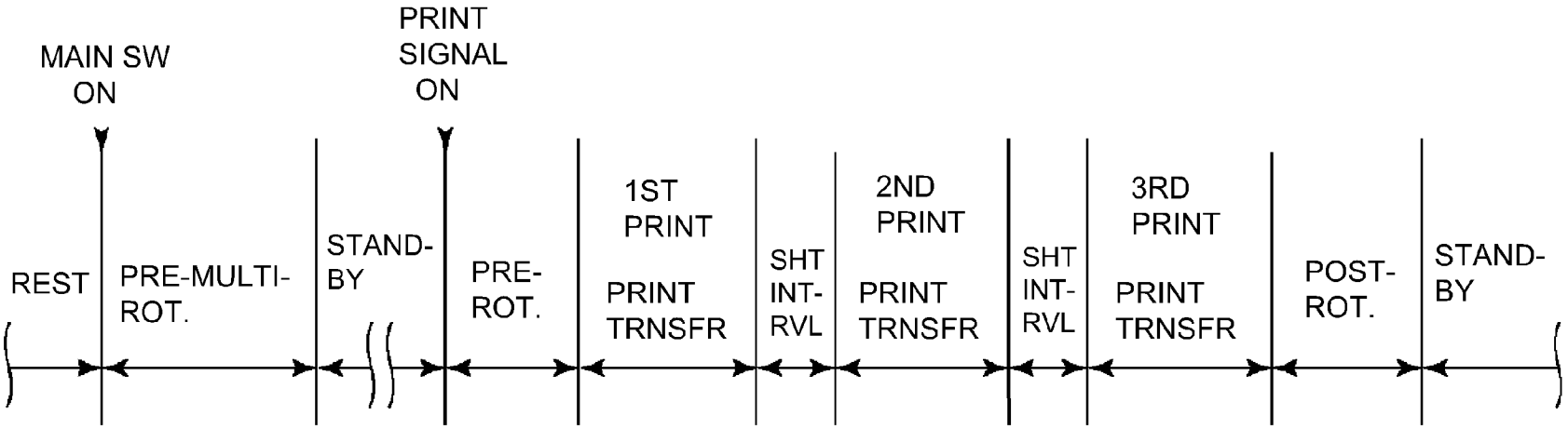
FIG. 3 is an operation sequence diagram of the image forming apparatus.

FIG. 3 is a time chart of the image forming sequence.

a. Initial Rotation Operation (Pre-Multi-Rotation Step)

This period is an actuation operation period during actuation of the printer (activation operation period, warming-up period). Preparatory operations (warming-up operations) of predetermined process devices, such as rise of the fixing device 9 to a predetermined temperature by rotationally driving the photosensitive members 1*a*-1*d* through turning-on of a main power switch are carried out.

b. Preparatory Rotation Operation for Printing (Pre-Rotation Step)

This period is a preparatory rotation operation period from print signal-ON until an image forming (print) step is actually performed, and when a print signal is inputted during the initial rotation operation, the preparatory rotation operation for printing is carried out subsequently to the initial rotation operation. When no print signal is inputted, drive of a main motor is temporarily stopped after the end of the initial rotation operation, the rotational drive of the photosensitive drum 1 is stopped, and the printer is kept in a stand-by (waiting) state until a print signal is inputted. When the print signal is inputted, the preparatory rotation operation for printing is carried out.

c. Printing Step (Image Forming Step, Imaging Step)

When the predetermined preparatory rotation operation for printing is ended, subsequently, an image forming process to the photosensitive drums 1*a*-1*d* is carried out. That is, primary transfer of the toner images formed on the photosensitive drums 1*a*-1*d* onto the intermediary transfer belt 7, secondary transfer onto the recording material P, and the fixing process are made and the printing step is ended.

In the case of continuous printing (continuous print) mode, the above-described printing step is repeatedly carried out correspondingly to a preset print number n.

d. Sheet Interval Step

This step is a period in which no recording material P is in the secondary transfer position after a trailing edge of a preceding recording material (sheet) passes through the secondary transfer position until a leading edge of a subsequent recording material (sheet) reaches the secondary transfer portion.

e. Post-Rotation Operation

This period is a period in which the drive of the main motor is continued for a while even after the printing step onto the final recording material is ended and the photosensitive drums 1*a*-1*d* are rotationally driven, so that a predetermined post-process operation is carried out.

f. Stand-by

When the predetermined post-rotation operation is ended, the drive of the main motor is stopped and the rotational drive of the photosensitive drums 1*a*-1*d* is stopped, and the printer is kept in the stand-by state until a next print signal is inputted.

In the case of print of only one sheet, the printer is put through the post-rotation operation after the printing is ended, and is in a stand-by state.

In the stand-by state, when the print signal is inputted, the printer goes to the pre-rotation step.

The above-described printing process c is performed during image formation, and the initial rotation operation a, the pre-rotation operation b, the sheet interval d, and the post-rotation operation e are performed during non-image formation.

(With Regard to Ghost Phenomenon)

In such a tandem-type image forming apparatus, for example, it is assumed that a red image (called R patch) obtained by superposing Y (yellow) and M (magenta) toners (maximum deposition amount, so-called solid) is formed. Thereafter, an HT image (half-tone image, also referred to as CHT) is formed in the image forming station for C (cyan). In such a case, a phenomenon that the CHT image partly this generated at a position after one full-turn of the photosensitive drum 1*c* from passing of the R patch through a transfer position (position of the primary transfer roller 5*c*). This is called a ghost phenomenon.

This phenomenon will be described using (b) of FIG. 10 which is a simplified view of FIG. 4. The R patch formed at the Y and M image forming stations of FIG. 4 is conveyed by the intermediary transfer belt 7 and reaches the transfer position between the photosensitive drum 1*c* and the primary transfer roller of the C image forming station.

Figure 10:
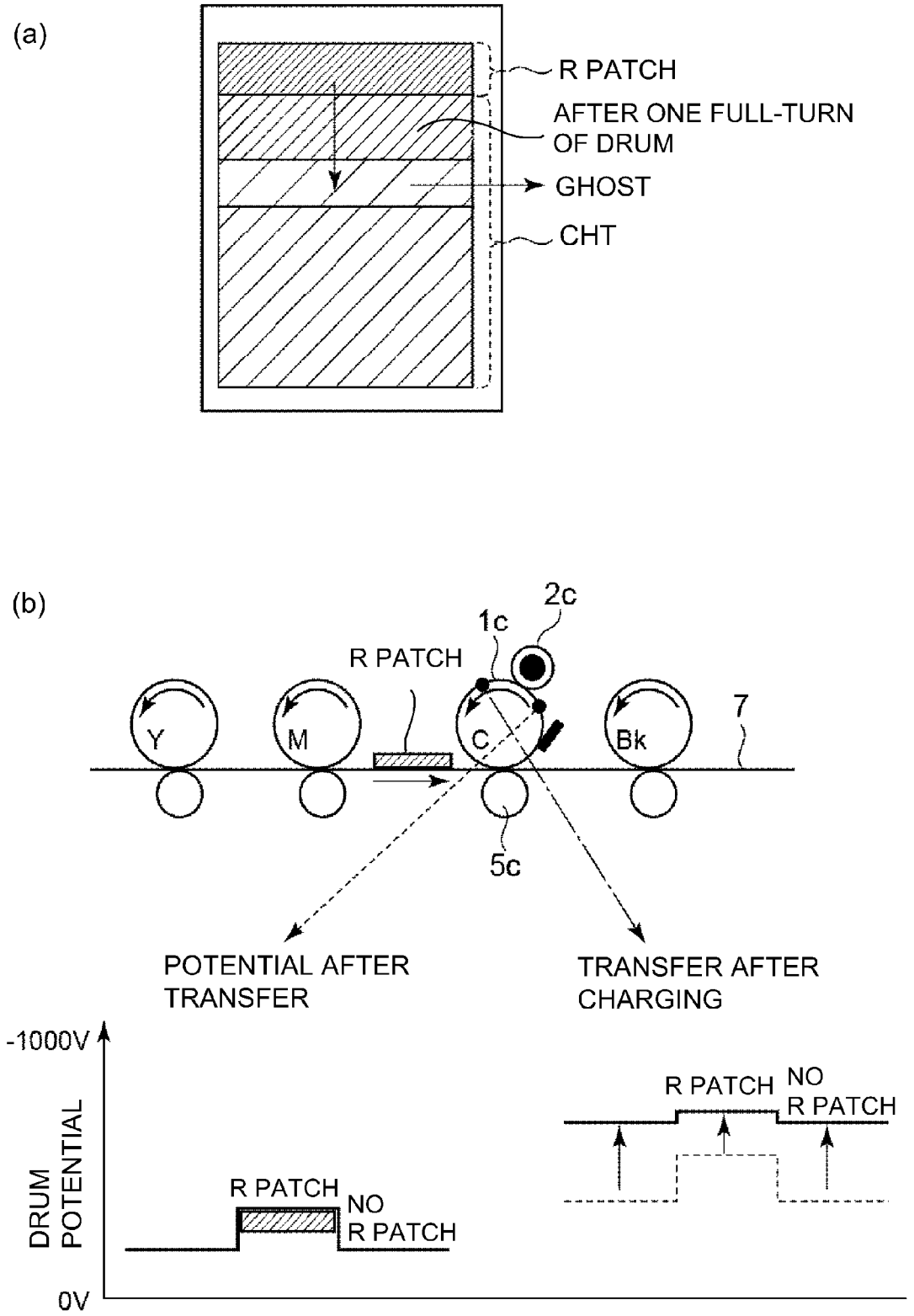
In FIG. 10, (a) is a view for illustrating a ghost phenomenon, and (b) is a view for illustrating a generation mechanism of the ghost phenomenon.

The ordinate of a graph at a lower portion of (b) of FIG. 10 shows a surface potential (negative potential) of the photosensitive drum 1*c*. Then, at a portion where the R patch exists, compared with a portion where there is no R patch, a residual potential of the photosensitive drum 1*c* after the primary transfer becomes high in a negative side. This is caused by that the toner of the R patch is the resistor as described above. That is, at the portion where the R patch exists, compared with the portion where there is no R patch, a current flowing when the primary transfer bias (positive voltage) is applied becomes small, and thus the above phenomenon is caused by that the residual potential of the photosensitive drum 1*c* does not completely lower toward a zero-potential (0 V).

Figure 1:
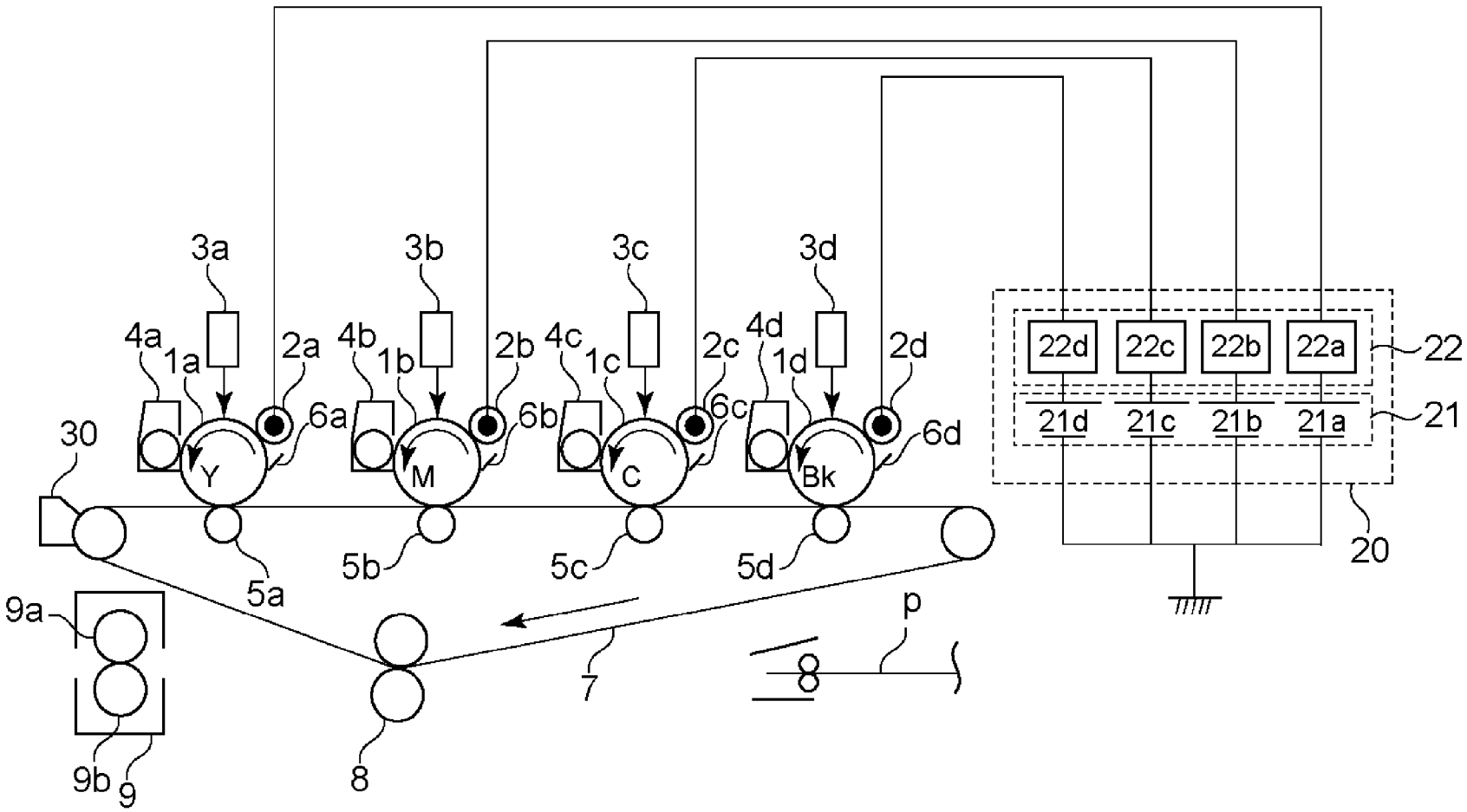
FIG. 1 is a schematic illustration of an image forming apparatus in which a pre-exposure device is not provided in all of image forming stations.

Then, in the case of the image forming apparatus as shown in FIG. 1 in which the pre-exposure device is not provided at all the image forming stations, thereafter even the photosensitive drum 1*c* is subjected to the charging process by the charging roller 2*c*, a difference in residual potential slightly remains as a hysteresis thereof. As a result thereof, the residual potential difference is to be capable of being recognized as a ghost on an image subsequently formed on the photosensitive drum 1*c*. This will be referred to as a ghost phenomenon.

This ghost phenomenon is, as described above, a phenomenon that generates when the toner formed at the upstream image forming station passes through the transfer position of the downstream image forming station. Further, the more the amount of the toner image formed at the upstream image forming station, the more this ghost phenomenon is liable to conspicuously generate.

In this embodiment, the toner amount when the R (red) image is formed with the Y toner and the M toner is capable of having the influence on image formation of C and Bk (black). Further, the toner amount when a G (green) image is formed with the Y toner and the C toner or the toner amount when a B (blue) image is formed with the M toner and the C toner is capable of having the influence on image formation of Bk.

Thus, in the case where an image of a secondary color (the case where the toners of two colors are superposed) such as R, G or B comes to the primary transfer position of the downstream image forming station, generation of the ghost phenomenon can be conspicuous in the downstream (C, Bk) image forming stations.

(Pre-Exposure Device)

Therefore, in this embodiment, as shown in FIG. 4, only at the C and Bk image forming stations (second image forming stations), the pre-exposure device as a discharging means was provided. 10*a* is the pre-exposure device for irradiating the photosensitive drum 1*c* with light between the transfer position of the transfer roller 5*c* and the charging position of the charging roller 2*c* with respect to a rotational direction of the photosensitive drum 1*c*. That is, the pre-exposure device 10*a* performs the function of lowering the potential of the photosensitive drum 1*c* to the neighborhood of 0 V uniformly by optically discharging the whole surface of the photosensitive drum 1*c*. Further, 10*b* is the pre-exposure device for irradiating the photosensitive drum 1*d* with light between the transfer position of the transfer roller 5*d* and the charging position of the charging roller 2*d* with respect to a rotational direction of the photosensitive drum 1*d*. That is, the pre-exposure device 10*d* performs the function of lowering the potential of the photosensitive drum 1*d* to the neighborhood of 0 V uniformly by optically discharging the whole surface of the photosensitive drum 1*d*.

In this embodiment, the pre-exposure devices 10*a* and 10*b* employ LEDs arranged in a longitudinal direction of the photosensitive drums 1*c* and 1*d*, and were 630 mm in peak wavelength and 130 μW in light quantity.

As the light quantity, a value (μW) measured by using an optical power meter TQ8210 manufactured by Advantest Corp. and by causing a light receiving portion of the power meter to oppose the pre-exposure devices 10*a* and 10*b* on the surfaces of the photosensitive drums 1*c* and 1*d* which are remotest from the pre-exposure devices 10*a* and 10*b* was used.

Further, timing of irradiation with pre-exposure light was during the printing step c. and during the sheet interval step d. of FIG. 3. That is, a region of the photosensitive drum which is subjected to the transfer and the charging was irradiated with the pre-exposure light.

By employing the above constitution, a post-transfer potential of the photosensitive drum of the downstream image forming station by the toner image coming from the upstream image forming station is made uniform to the neighborhood of 0 V by the pre-exposure devices 10*a* and 10*b* irrespective of the toner amount. Accordingly, in the downstream image forming station, the generation of the ghost phenomenon is suppressed.

Further, in the first and second image forming stations for Y and M, a large potential difference after the transfer and a large potential difference after the charging as in the graph at the lower portion of (b) of FIG. 10 did not generate. Accordingly, in the Y and M image forming stations, pre-exposure devices corresponding to 10*a* and 10*b* are not provided.

Incidentally, in the M image forming station, some potential difference after the transfer generates by passing of the toner image formed in the upstream Y image forming station. However, a maximum toner amount of Y (corresponding to one color) is remarkably small compared with the toner amount of the R patch (corresponding to two colors), and therefore the potential difference after the charging as shown in (b) of FIG. 10 does not generate, so that the ghost phenomenon did not generate in the M image forming station.

Accordingly, in this embodiment, the pre-exposure device is not provided in the Y and M image forming stations, and the pre-exposure devices (10*a*, 10*b*) are provided in the C and Bk image forming stations. Therefore, while employing the DC charging type capable of enjoying a cost reduction effect, all the image forming stations are not required to be provided with the pre-exposure device, and therefore it is possible to suppress the generation of the ghost phenomenon while reducing the costs.

(ON/OFF Control of Pre-Exposure Device)

Next, ON/OFF (actuation/non-actuation) control of the pre-exposure devices (10*a*, 10*b*) provided in the downstream image forming station (C, Bk) will be described.

When the ghost phenomenon is suppressed in the downstream image forming stations (C, Bk), the following would be considered. That is, in the case where the pre-exposure devices 10*a* and 10*b* are turned on irrespective of the image data for Y (to which the toner amount of Y corresponds) and the image data for M (to which the toner amount of M corresponds), the turning-on of the pre-exposure devices is disadvantageous in some instances.

This is because subjection to light irradiation from the pre-exposure devices 10*a* and 10*b* constitutes a factor of deterioration promotion of the photosensitive drums 1*c* and 1*d*. That is, the potentials of the photosensitive drums 1*c* and 1*d* before the charging step are made uniform to the neighborhood of 0 V by the pre-exposure devices 10*a* and 10*b*, and therefore, the potential difference becomes large before and after the charging step. By this potential difference, a discharge current amount by the charging devices 2*c* and 2*d* becomes large, so that discharge damage on the photosensitive drums 1*c* and 1*d* becomes large.

As a result thereof, the photosensitive drums 1*c* and 1*d* become worse in dark-decay characteristic (a surface potential lowering speed becomes faster than at an initial stage), and due to this, there is an increasing liability that improper charging generates when the DC charging is made by the charging devices 2*c* and 2*d*. Further, the photosensitive drums 1*c* and 1*d* are liable to abrade at rubbing (sliding) portions such as cleaning devices (blades) 6*c* and 6*d*.

Specifically, the photosensitive drums 1*c* and 1*d* of the C and Bk image forming stations had an abrasion amount (decreased in film thickness of a photosensitive layer) which was 1.5 times that of the photosensitive drums 1*a* and 1*b* of the Y and M image forming stations.

Figure 5:
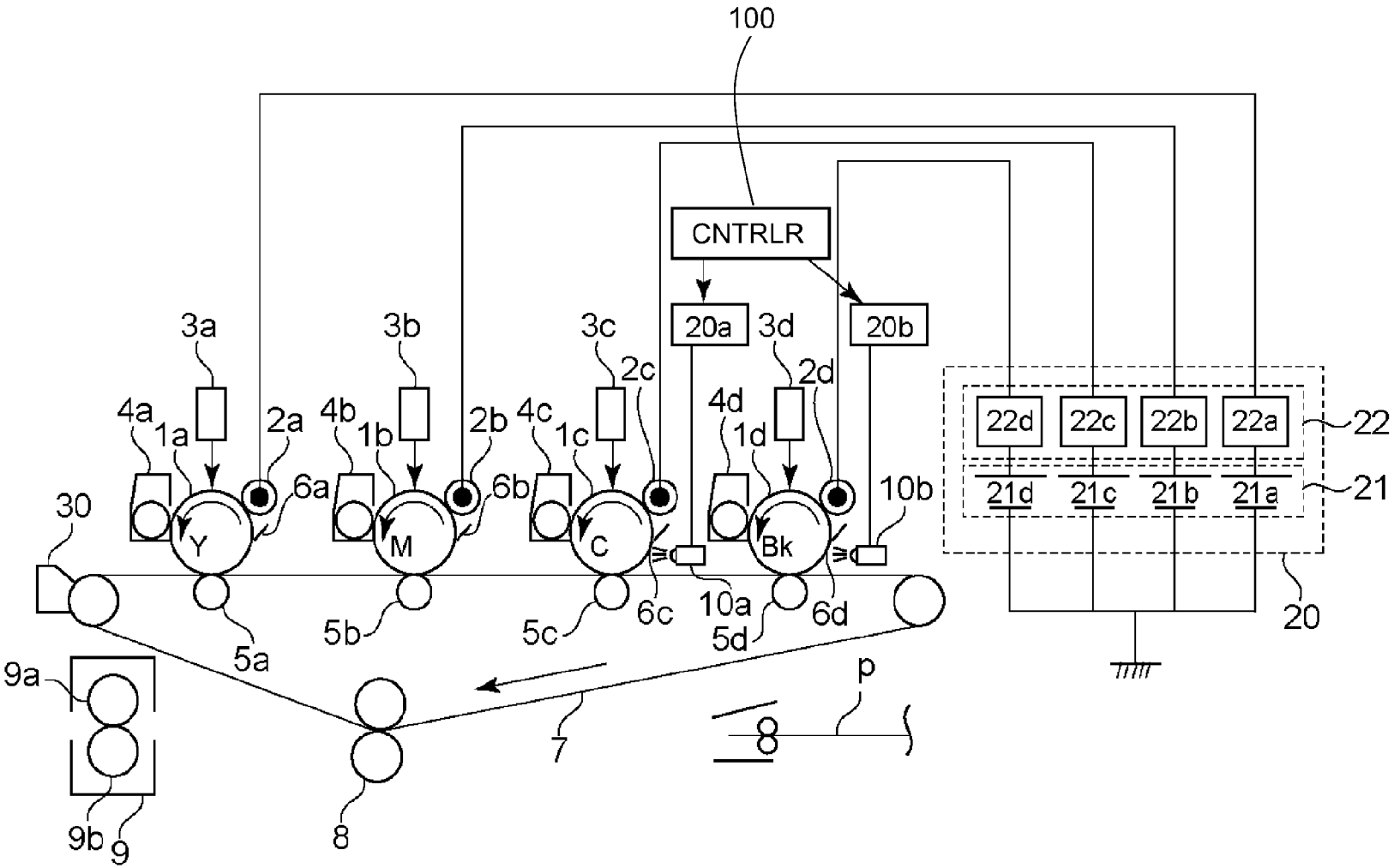
FIG. 5 is a schematic illustration of an image forming apparatus.

Therefore, in this embodiment, as shown in FIG. 5, pre-exposure controlling devices (functioning as a part of control means) 20*a* and 20*b* for controlling operations (on/off) of the pre-exposure devices 10*a* and 10*b* are provided, and the pre-exposure devices 10*a* and 10*b* were turned off depending on a condition.

FIG. 6 shows a block diagram in this embodiment. Image data sent from a host computer (e.g., a PC) network-connected with the image forming apparatus (printer) via a LAN cable are inputted into an image input portion and then are stored in an image data memory. Then, of the image data stored in the image data memory, the image data of Y, M and C are transmitted to a controller (control means) 100.

Incidentally, in the case where the image forming apparatus has a copying function, image data of an original read by a mounted original reading device are inputted into the image input portion, and subsequent steps are the same as those in the case of the above-described printer.

Then, on the basis of whether the sum of the toner amount of Y corresponding to the Y image data of the image data and the toner amount of M corresponding to the M image data of the image data is not less than a predetermined amount or less than the predetermined amount, the on/on of the pre-exposure devices 10*a* and 10*b* is controlled. Specifically, whether or not a maximum value of the sum of image signals which are image information of an overlapping portion of the image data of Y and M is not less than a predetermined value A is discriminated by the controller (CPU) 100. Incidentally, the overlapping portion of the image data corresponds to an overlapping region of the Y toner and the M toner on the intermediary transfer belt 7 (recording material P).

In this embodiment, the image data were obtained by measuring a reflection density of a solid image (maximum density image) formed on the recording material P by a spectral densitometer (503 manufactured by X-Rite Inc.). If the image signal is in a range of 0-255, when the image signal is 255, the reflection density was set at 1.4, a maximum reflection density corresponding to the toner of one color is 1.4.

Further, in this embodiment, the predetermined amount A was the case where the image signal at the overlapping portion of the Y image signal and the M image signal was 450 (maximum image signal (maximum toner deposition amount) of Y and M was 510).

Further, a flow in which whether or not a maximum value of the sum of image signals which are image information at an overlapping portion of the image data of Y, M and C is not less than a predetermined value B is discriminated by the controller 100 is used in combination.

In this embodiment, the predetermined value B was the case where an image signal at an overlapping portion of the image signals Y, M and C was 450 (maximum (maximum toner deposition amount) of the sum of Y, M and C was 510). Thus, in consideration of fixing process power in the fixing device 9, a maximum total toner deposition amount in the case where Y and M overlap with each other and a total maximum toner deposition amount in the case where Y, M and C overlap with each other are set at the same value.

(Control Sequence of Photosensitive Drum)

In this embodiment, in the case where not less than the predetermined values A and B is discriminated by the controller 100, the information is transmitted to the pre-exposure controlling devices 20*a* and 20*b*, and the pre-exposure controlling devices 20*a* and 20*b* provide operation instructions for turning on the pre-exposure devices 10*a* and 10*b*, respectively.

That is, in the case where in a certain downstream image forming station (e.g., the Bk image forming station), the density of the toner image passing through the transfer position thereof on the intermediary transfer belt 7 is not less than a predetermined density (in the case where the maximum value of the sum of the image signals is not less than the predetermined value), the pre-exposure devices are turned on.

On the other hand, in the case where in the certain image forming station (e.g., the Bk image forming station), the density of the toner image passing through the transfer position thereof on the intermediary transfer belt 7 is less than the predetermined density (in the case where the maximum value of the sum of the image signals is less than the predetermined value), the pre-exposure devices are turned off.

Thus, whether the pre-exposure devices are turned on or off is discriminated by the controller 100 depending on the amount of the toner conveyed to the associated transfer position by the intermediary transfer belt 7.

Figure 7:
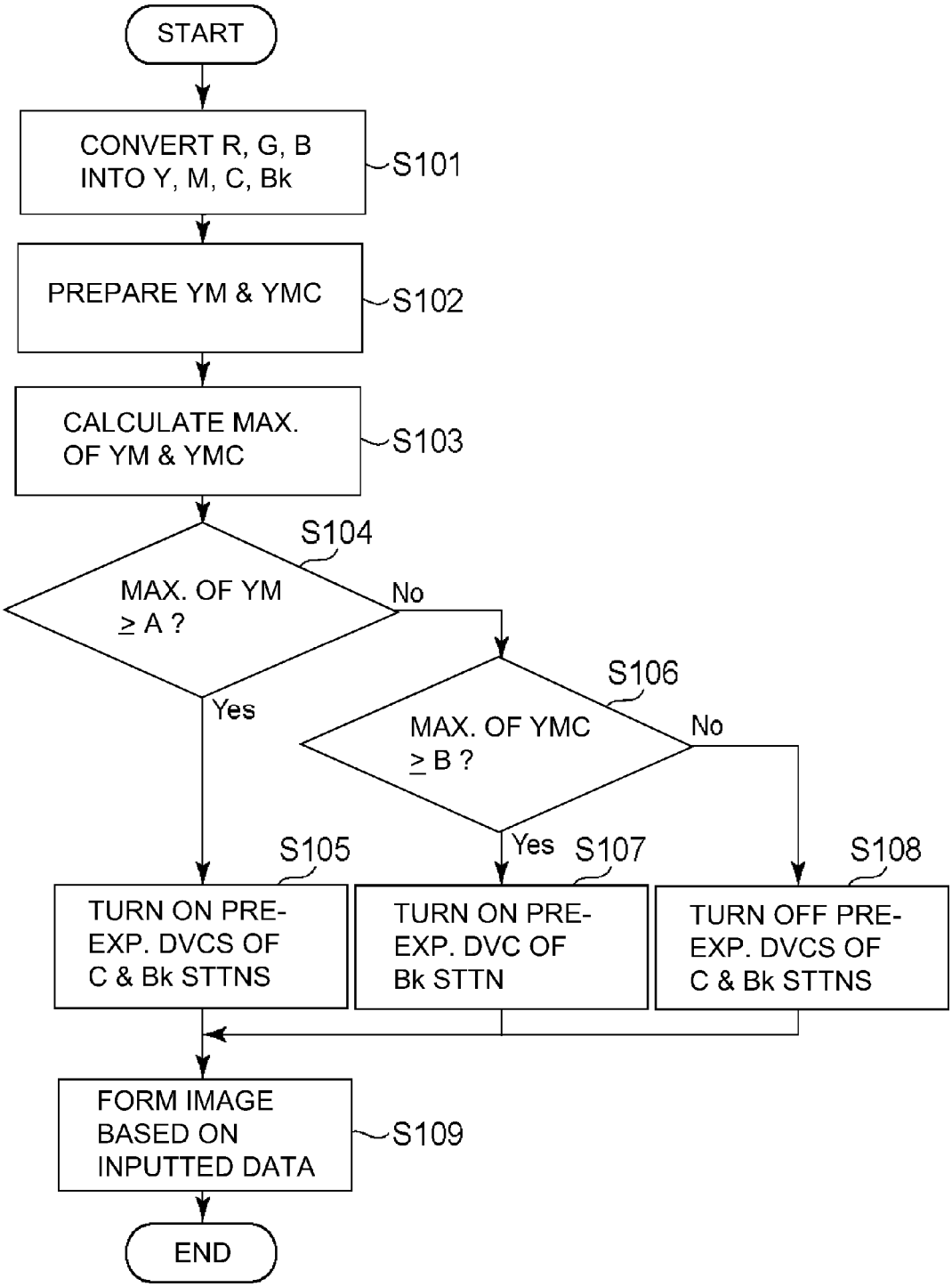
FIG. 7 is a flowchart of ON/OFF control of the pre-exposure device.

FIG. 7 shows an operation flow.

In the image forming apparatus of FIG. 5, when image formation is started, inputted image data (image data of R, G and B) are converted into image data of Y, M, C and Bk in an image data converting portion in the controller 100 (S101). Of the converted image data, image data YM obtained by synthesizing the Y and M image data and image data YMC obtained by synthesizing the Y, M and C image data are prepared by the controller 100 (S102).

Next, amount values of the image data YM and the image data YMC are calculated by the controller 100 (S103). Next, whether the maximum value of the image data YM is not less than the predetermined value A is discriminated by the controller 100 (S104). Thus, the discrimination is made using the image data in the two image forming stations (Y, M) in the upstream side.

When the maximum amount is not less than the predetermined amount A, the pre-exposure devices 20*a* and 20*b* of the C and Bk image forming stations positioned downstream of the Y and M image forming stations are turned on (S105).

In S104, when the maximum amount is less than the predetermined amount A, whether or not the maximum amount of the image data YMC is not less than the predetermined value B is discriminated by the controller 100 (S106). Thus, the discrimination is made using the image data in the image forming stations (Y, M, C) other than the most downstream Bk image forming station.

When the maximum amount is not less than the predetermined amount B, the pre-exposure device 20*b* of the Bk image forming station positioned downstream of Y, M and C image forming stations is turned on (S107).

In S106, when the maximum amount is less than the predetermined amount B, the pre-exposure device of the C and Bk image forming stations are still turned off even at desired timing (S108). Next, after the on/off discriminations of the pre-exposure devices in S105, S107 and S108, on the basis of the inputted image data, the respective color images are formed at the respective image forming stations (S109).

Incidentally, a light irradiation condition by the pre-exposure device is 630 nm in peak wavelength and 130 μW in light quantity, and the turning-on timing of the pre-exposure device is periods of the printing step c. and the sheet interval step d. in FIG. 3.

As described above, control in which the photosensitive drum of the downstream image forming station is turned on only in the case where the toner in a predetermined amount or more comes from the upstream image forming station and in other cases, the light irradiation by the pre-exposure device is not effected is made. As a result, it is possible to not only suppress the generation of the ghost phenomenon in the downstream image forming station but also prolong a lifetime of the photosensitive member of the downstream image forming station.

Embodiment 2

Next, Embodiment 2 will be described. A basic constitution of an image forming apparatus is the same as that of Embodiment 1, and therefore, will be omitted from detailed description by adding the same reference numerals or symbols.

In Embodiment 2, compared with the control constitution of Embodiment 1, a point that a charging bias applied to the charging rollers 2*c* and 2*d* is switched between the case where the pre-exposure devices (10*a*, 10*b*) provided in the downstream image forming stations (C, Bk) are turned on and the case where the pre-exposure devices are turned off, is largely different.

This is because the density of the image formed in the downstream image forming station changes between the case of turning-off of the pre-exposure device and the case of turning-on of the pre-exposure device.

Figure 8:
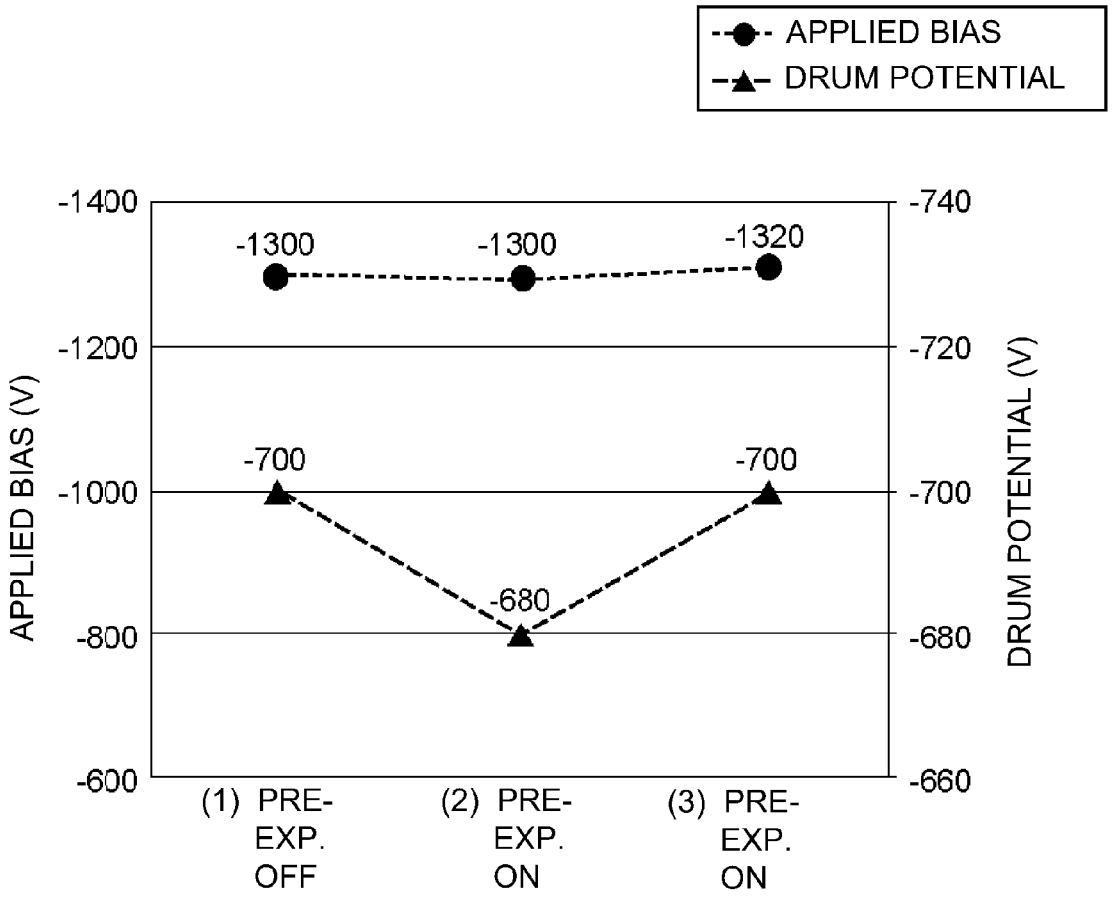
FIG. 8 is a view showing a relationship among ON/OFF of the pre-exposure device, a charging bias and a charge potential of the photosensitive member.

FIG. 8 shows a relationship between a bias applied to the charging roller 2*c* and a potential (Vd) of the photosensitive drum 1*c* at the developing position in the case of turning-on of the pre-exposure device 10*a* of the c image forming station and in the case of turning-off of the pre-exposure device 10*a*.

First, in the case where the pre-exposure device 10*a* is turned off in (1), the applied charging bias is −1300 V, whereas Vd is −700 V. Under the condition, in the case where the pre-exposure device 10*a* is turned on in (2), the applied charging bias was −1300 V, whereas the potential of the photosensitive drum 1*c* at the developing position was −680 V.

The reason why a difference (20 V) generates between the potentials of this photosensitive drum 1*c* is that there is a difference in dark-decay characteristic between the case where the pre-exposure device 10*a* is turned off and the case where the pre-exposure device 10*a* is turned off. This dark-decay characteristic is, as described above, a phenomenon that after the photosensitive member is charged to a desired potential by the charging device, the potential of the photosensitive member naturally lowers with lapse of time.

In the case where the pre-exposure device 10*c* is turned on, the potential of the photosensitive drum 1*c* is optically discharged to the neighborhood of 0 V, and therefore, in the photosensitive drum 1*c*, a photo-carrier tends to generate in a larger amount than during the light irradiation by the exposure device 3*c* for effecting the image exposure. In the case where the light irradiation is effected by the exposure device 3*c*, this photo-carrier flows from the electroconductive substrate of the photosensitive drum 1*c* toward the earth (grounding), but in the case where the light irradiation is effected by the pre-exposure device 10*a*, the photo-carrier remains in the photosensitive drum 1*a* although an amount thereof is slight.

Therefore, in the case where the pre-exposure device 10*a* is turned on, compared with the case where the pre-exposure device 10*a* is turned off, by a residual photo-carrier in the photosensitive drum 1*c*, the dark-decay phenomenon until the charged portion reaches the developing position (position opposing 4*c*) becomes large. That is, in the case where the pre-exposure device 10*a* is turned on, compared with the case where the pre-exposure device 10*a* is turned off, the charge potential of the photosensitive drum 1*c* lowers in larger degree (absolute value). As a result, in the case where the pre-exposure device 10*a* is turned on, compared with the case where the pre-exposure device 10*a* is turned off, there is a liability that the toner image density becomes dense unintendedly.

Therefore, in this embodiment, such an unintended fluctuation of the image density is corrected. That is, as shown in (3) of FIG. 8, the applied charging bias may preferably be switched from −1300 V to −1320 V. In other words, the applied charging bias applied to the charging device 2*c* in the case where the pre-exposure device 10*a* is turned on is switched so as to be larger in absolute value than that in the case where the pre-exposure device 10*a* is turned off.

Incidentally, in the above, the C image forming station was specifically described, but also with regard to the Bk image forming station including the pre-exposure device 10*b*, the applied charging bias applied to the charging device 2*d* may preferably be switched similarly.

Thus, in order to correct the above-described density fluctuation, in this embodiment, the following control was employed specifically.

Figure 9:
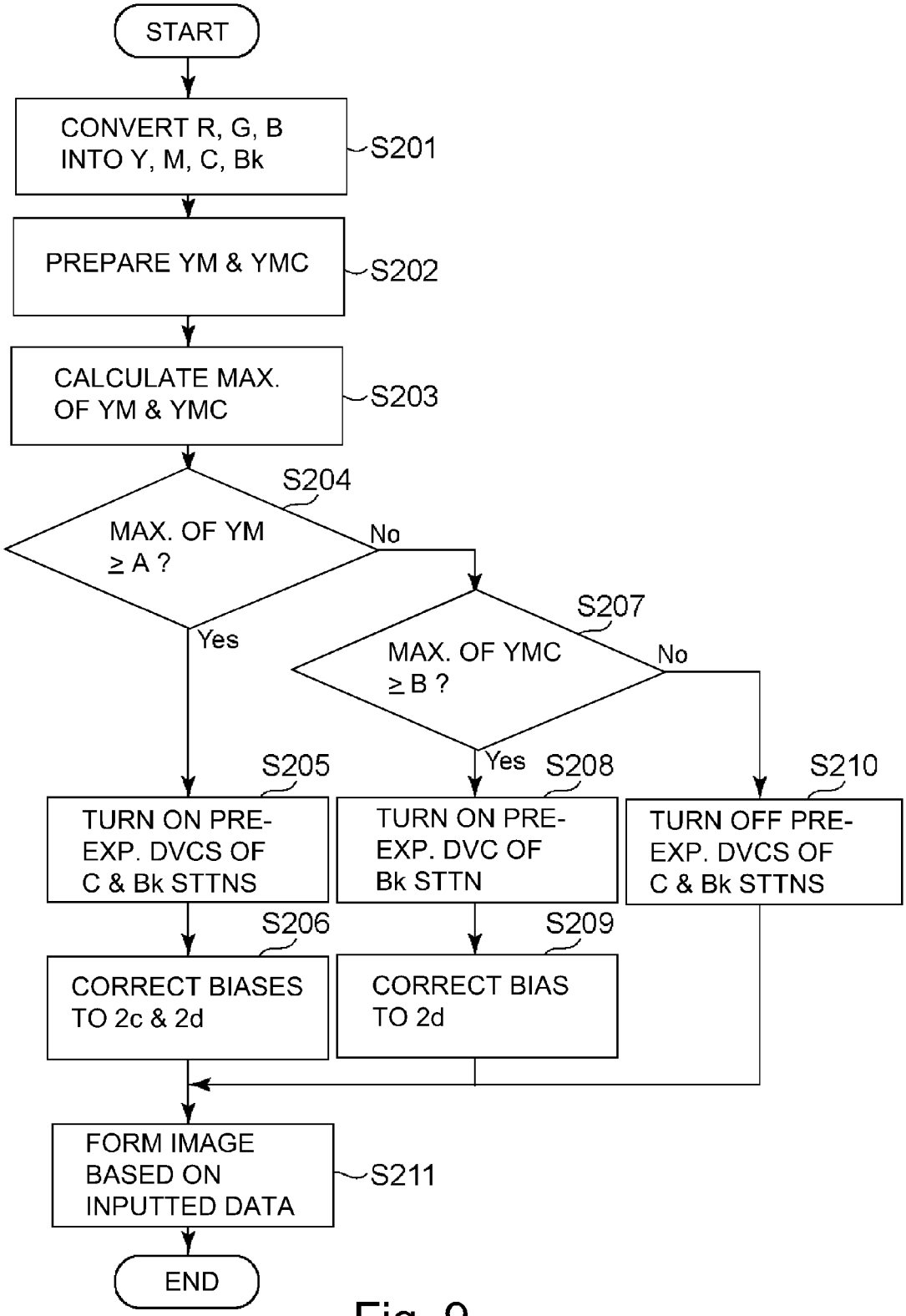
FIG. 9 is a flowchart of ON/OFF control of a pre-exposure device.

FIG. 9 is an operation flow.

In the image forming apparatus of FIG. 5, when image formation is started, inputted image data (image data of R, G and B) are converted into image data of Y, M, C and Bk in an image data converting portion in the controller 100 (S201). Of the converted image data, image data YM obtained by synthesizing the Y and M image data and image data YMC obtained by synthesizing the Y, M and C image data are prepared by the controller 100 (S202).

Next, amount values of the image data YM and the image data YMC are calculated by the controller 100 (S203).

Next, whether the maximum value of the image data YM is not less than the predetermined value A is discriminated by the controller 100 (S204). Thus, the discrimination is made using the image data in the two image forming stations (Y, M) in the upstream side.

Thereafter, as described above, the applied bias to the charging rollers 2*c* and 2*d* is corrected. In this embodiment, the applied bias was changed from −1300 V to −1320 V (S206).

In S204, when the maximum amount is less than the predetermined amount A, whether or not the maximum amount of the image data YMC is not less than the predetermined value B is discriminated (S207).

When the maximum amount is not less than the predetermined amount B, the pre-exposure device 20*b* of the Bk image forming station positioned downstream of Y, M and C image forming stations is turned on (S208).

Thereafter, as described above, the applied bias to the charging roller 2*d* is corrected. In this embodiment, the applied bias was corrected from −1300 V to −1320 V (S209).

In S207, when the maximum amount is less than the predetermined amount B, the pre-exposure devices 10*a* and 10*b* of the C and Bk image forming stations are set to be turned off (S210).

After the on/off discriminations of the pre-exposure devices and the applied charging bias correcting step in S206, S209 and S210, on the basis of the inputted image data, the respective color images are formed at the respective image forming stations (S211). Incidentally, a light irradiation condition for the pre-exposure device was, similarly as in Embodiment 1, 630 nm in peak wavelength and 130 μW in light quantity. Further, the light irradiation by the pre-exposure device was effected in periods of the printing step c. and the sheet interval step d. in FIG. 3.

Thus, in this embodiment, in addition to the advantage of the constitution of Embodiment 2, it becomes possible to suppress the fluctuation in image density in the case where the pre-exposure device is turned on.

Embodiment 3

Next, Embodiment 3 will be described. A basic constitution of an image forming apparatus is the same as those of Embodiment 1, and therefore, will be omitted from detailed description by adding the same reference numerals or symbols.

In Embodiment 3, a point that as a condition for turning on/off the pre-exposure devices (10*a*, 10*b*) provided in the downstream image forming stations (C, Bk), also densities of the toner images formed in the downstream image forming stations (C, Bk) are taken into consideration is largely different.

(Image Processing Portion)

Figure 12:
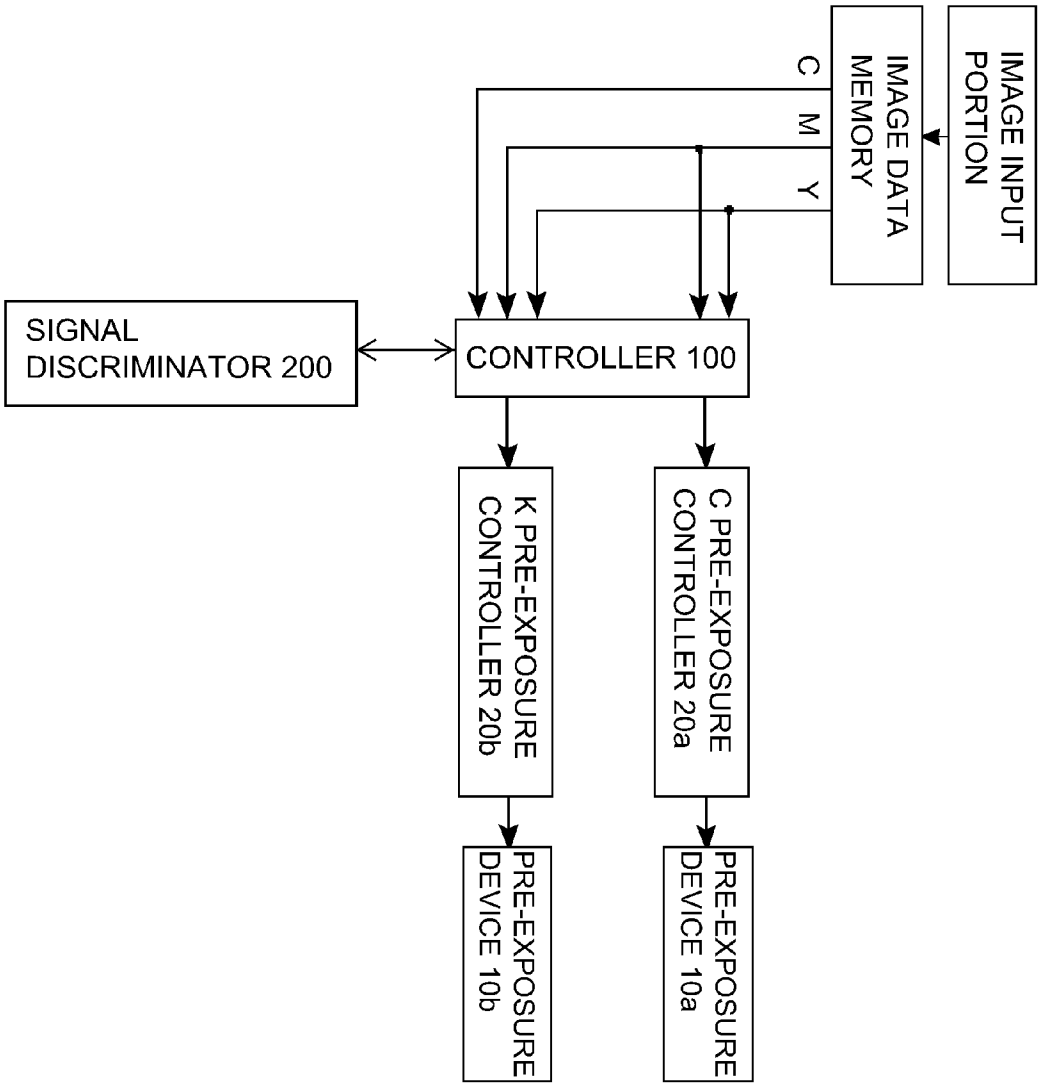
FIG. 12 is a block diagram of an image processing portion.

First, a constitution of an image processing portion will be described. FIG. 12 is a block diagram showing a schematic structural example of the image processing portion.

Of image data stored in an image data memory through the image input portion, the Y, M and C image data are transmitted to the controller (control means) 100. The controller is connected with a signal discriminating portion 200, and the signal discriminating portion 200 makes discrimination of the image data. In this embodiment, for discriminating the image data, reference to a print ratio, a color, a signal amount and an image signal value is made.

[Light Quantity Control of Pre-Exposure Device)

The pre-exposure devices 10*a* and 10*b* in this embodiment have a constitution in which light is emitted from an LED lamp provided at an end portion of a light guide (light guiding member) and the surface potential of the photosensitive member 1 is removed by the light reflected from a side surface of the light guide. As the light guide, a resin (acrylic, polycarbonate, polystyrene, etc.) or glass or the like which are excellent in light transmittance is used. Further, in this embodiment, a single LED lamp is provided in a position opposing a side surface of the light guide in one side, but in the case where the light quantity is insufficient or in the like case, two LED lamps in total may also be provided in positions opposing both side surfaces of the light guide one by one.

Further, in this embodiment, the pre-exposure controlling devices 20*a* and 20*b* include pre-exposure amount controlling circuits, respectively. The pre-exposure amount controlling circuit is capable of controlling a current of the LED lamp from 0 mA to 20 mA at the maximum by a PWM (Pulse Width Modulation) circuit.

The PWM circuit is a circuit for controlling a current flowing into the LED lamp by changing a duty cycle of a pulse width depending on a magnitude of the image signal with a certain period. That is, by increasing the duty, a ratio of a High signal (ON) to a Low signal (OFF) becomes high, so that the current flowing into the LED lamp increases. On the other hand, by decreasing the duty, ratio of the Low signal to the High signal becomes high, so that the current flowing into the LED lamp decreases.

Figure 15:
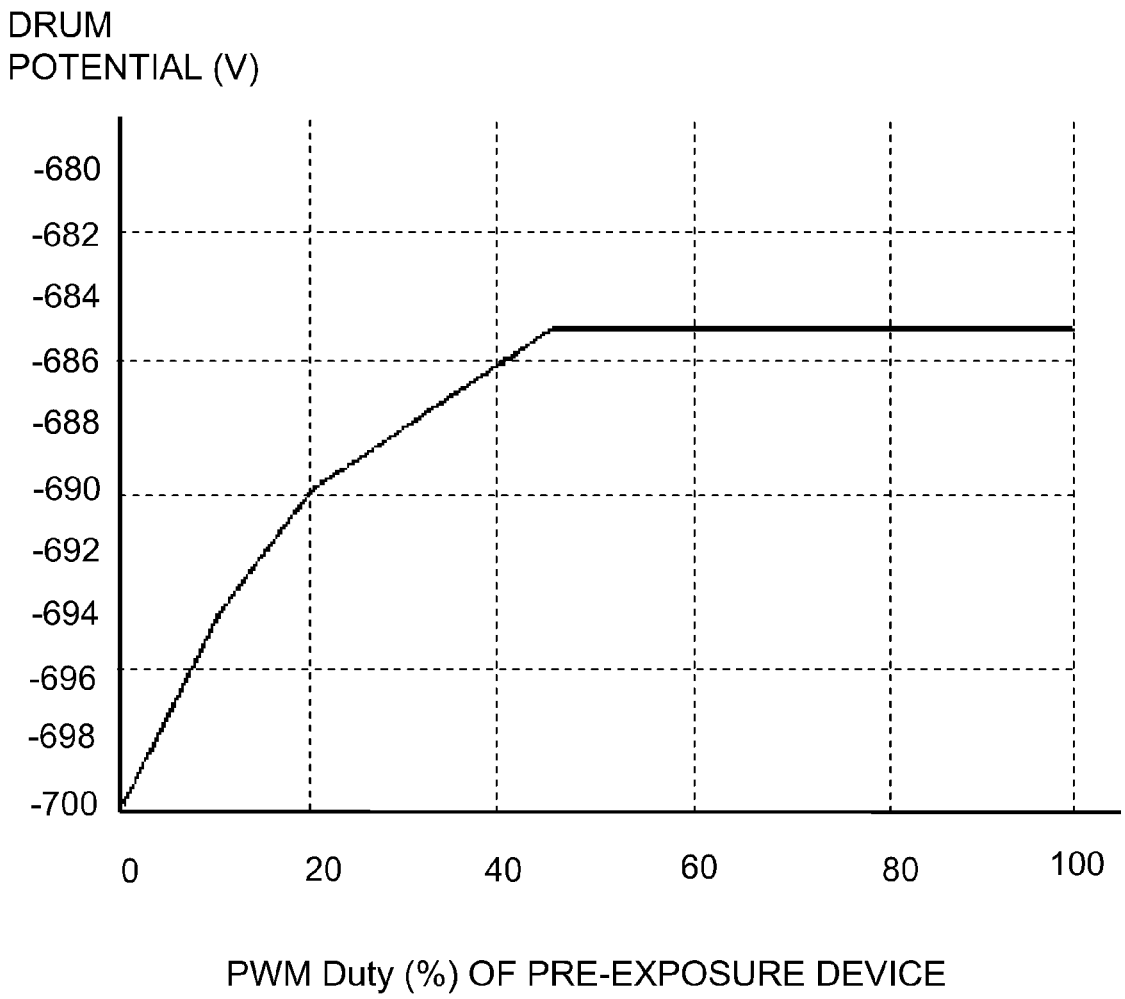
FIG. 15 is a view showing a relationship between a light quantity by the pre-exposure device and a surface potential of a photosensitive member.

Further, as shown in FIG. 15, a current amount of the LED lamp has a linear relation to the exposure amount and further has a linear relation to the PWM duty. That is, when the PWM duty is 0%, the current is 0 mA and when the PWM duty is 100%, the current is 20 mA, so that the surface potentials of the photosensitive members (1*c*, 1*d*) immediately before entering the charging devices (2*c*, 2*d*) vary depending on the PWM Duty (%).

In the case of the DC charging type, the surface potential immediately before the entrance varies, whereby also the surface potentials of the photosensitive members (1*c*, 1*d*) immediately after passing through the charging devices (2*c*, 2*d*) vary. For example, by increasing the PWM Duty, the surface potentials of the photosensitive members (1*c*, 1*d*) can be further lowered.

Figure 16:
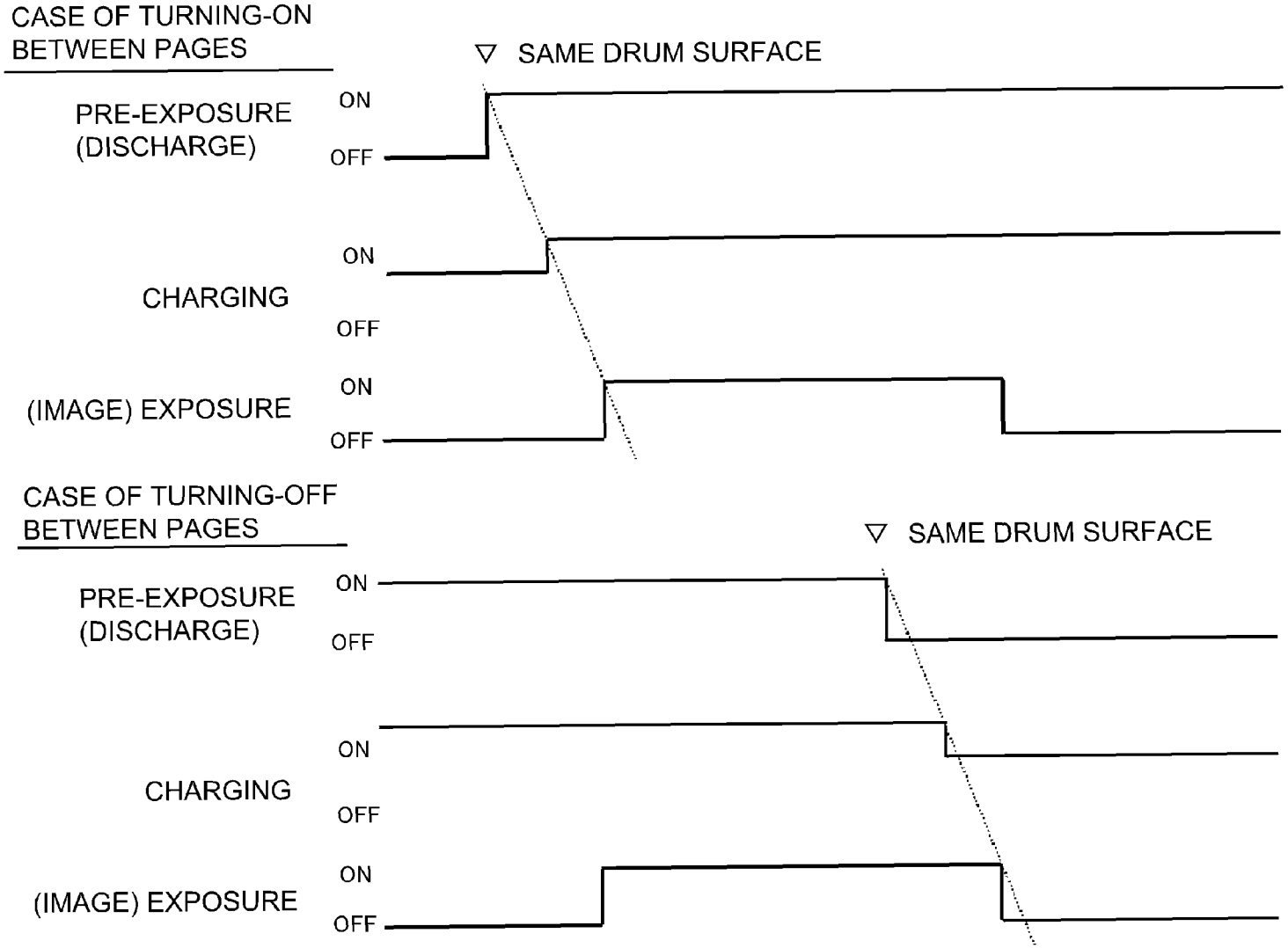
FIG. 16 is a timing chart for illustrating turning ON/OFF timing of the pre-exposure device.

Further, in FIG. 16, change timings of turning-on/turning-off of the pre-exposure devices (10*a*, 10*b*) and the voltage (charging bias) applied to the charging devices (2*c*, 2*d*) are shown. For the above-described reasons, in the case where the voltage applied to the charging devices (2*c*, 2*d*) is changed depending on the PWM Duty, it is not preferable that switching of a high-voltage output is made in the middle of an image. This is because density non-uniformity generates on the image due to the change in voltage applied to the charging devices (2*c*, 2*d*).

Therefore, the pre-exposure controlling devices (20*a*, 20*b*) are as follows in the case where the pre-exposure devices (10*a*, 10*b*) are turned on between pages (between a preceding image and its subsequent image). That is, the pre-exposure devices (10*a*, 10*b*) are turned on when portions, of the photosensitive member (1*c*, 1*d*), constituting leading ends of images to be outputted after this pass through opposing portions to the pre-exposure devices (10*a*, 10*b*). Further, in the case where the pre-exposure devices (10*a*, 10*b*) are turned off between pages, the pre-exposure controlling devices are as follows. That is, the pre-exposure devices (10*a*, 10*b*) are turned off when portions, of the photosensitive members (1*c*, 1*d*), constituting trailing ends of images pass through opposing portions to the pre-exposure devices (10*a*, 10*b*).

As a result, it becomes possible to suppress generation of density non-uniformity due to turning-on/non-turning-on of the pre-exposure device on the toner image formed on the basis of the image information of the original.

Thus, with an increase in current amount (PWM duty) to the pre-exposure devices 10*a* and 10*b*, the amount of the current flowing into the charging devices 2*c* and 2*d* in the charging step becomes large. However, in the case where the current amount (PWM duty) to the pre-exposure devices 10*a* and 10*b* is increased, although the generation of the ghost phenomenon can be suppressed, there is liability that it leads to hastening of a lowering in lifetime of the photosensitive members 1*c* and 1*d*. That is, there is a liability that abrasion of the photosensitive members is promoted by the increase in current flowing from the charging devices 2*c* and 2*d* into the photosensitive members 1*c* and 1*d*.

Further, there is liability that a deterioration of photosensitivity of the photosensitive members 1*c* and 1*d* is promoted by light irradiation by the pre-exposure devices 10*a* and 10*b*.

More specifically, it is presumed that the photosensitive layers of the photosensitive members 1*c* and 1*d* deteriorate by repetitively receive strong light from the pre-exposure devices and a stagnation phenomenon of photo-carries in the photosensitive layers becomes worse to cause the promotion of the photosensitivity deterioration. That is, the light-portion potential is unintendedly increased (in a direction of a negative potential), with the result that a density change of the toner image also increases. Thus, by excessively strongly irradiating the photosensitive member with light more than necessary from the pre-exposure devices 10*a* and 10*b*, an image defect such as a density lowering due to the increase in light-portion potential (VL) is promoted.

Further, as a factor of deteriorating the surfaces of the photosensitive members 1*c* and 1*d* when the photosensitive members 1*c* and 1*d* are charged, (a magnitude of) a potential difference between the charging potential when passing through the charging devices 2*c* and 2*d* and the potential immediately before the passage of the photosensitive members 1*c* and 1*d* through the charging devices 2*c* and 2*d*. That is, when the potential difference between the potential of the charging devices 2*c* and 2*d* and the potential of the photosensitive members 1*c* and 1*d* immediately before passing through the charging devices 2*c* and 2*d* (hereinafter referred to as a "charging contrast") is large, a large DC current in an amount for compensating for the potential difference will flow from the charging devices 2*c* and 2*d* into the photosensitive members 1*c* and 1*d*.

For that reason, the deterioration of the photosensitive members 1*c* and 1*d* due to electric discharge is to be promoted. When the deterioration due to the electric discharge progresses, in an environment of a high temperature and a high humidity, a phenomenon which is image flow (deletion) generates and there is a liability that the phenomenon leads to generation of the image defect such as image blur.

Further, when the deterioration due to the electric discharge progresses, in a low humidity environment, there is a liability that the deterioration leads to promotion of generation of melt-sticking of the toner to the photosensitive members 1*c* and 1*d* (so-called filming).

Accordingly, it is desirable that the charging contrast can be maintained in a minimized state, but also in this case, a problem is light irradiation by the pre-exposure devices 10*a* and 10*b*.

That is, when an irradiation light quantity of the pre-exposure devices 10*a* and 10*b* is excessively strong (large), the photosensitive members 1*c* and 1*d* are discharged to the neighborhood of 0 V before the portions thereof reach the charging devices 2*c* and 2*d*, and therefore, the deterioration of the photosensitive member due to the above-mentioned electric discharge is to be promoted.

Therefore, it is understood that control of the light quantity by the pre-exposure device is an important factor regarding the lifetime of the photosensitive member and the image quality.

(Reason why Amount of Toner Image Formed in Downstream Image Forming Station is Taken into Consideration)

First, control of the pre-exposure device 10*b* relating to the Bk image forming station will be described.

Figure 18:
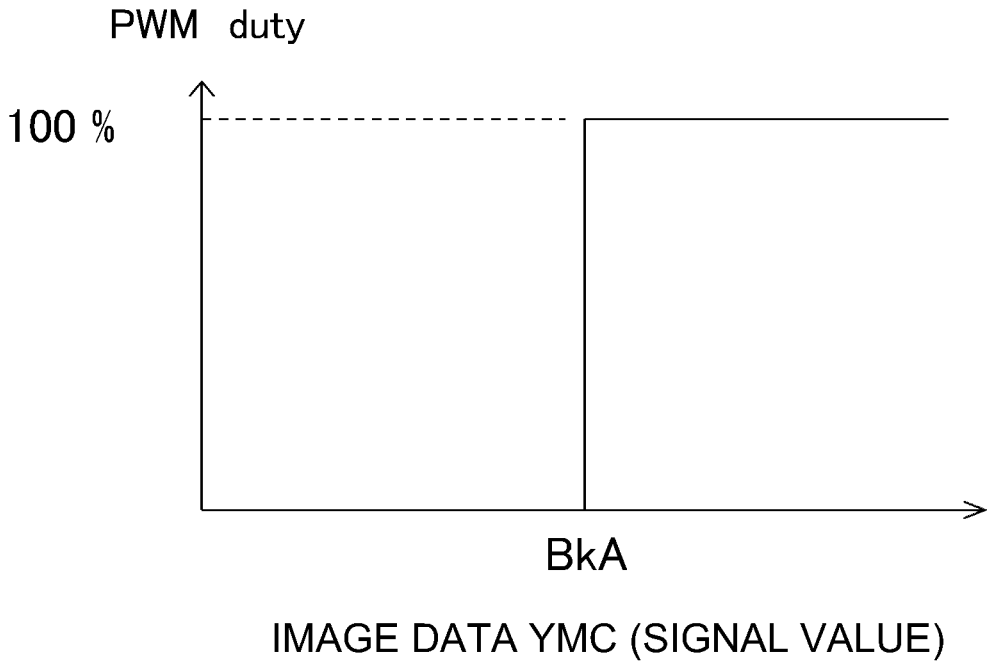
FIG. 18 is a view showing a relationship between image data YMC and a PWM duty.

In FIG. 18, a relationship between image data YMC (signal value) and PWM Duty (%) corresponding to a supplied current to the pre-exposure device 10*b* is shown. The abscissa is a total amount of signal values of the image data YMC, and the ordinate is the PWM duty (%) of the pre-exposure device 10*b*.

In this embodiment, in the case where the total member of the signal values of the image data YMC exceeds a threshold BkA, the PWM duty (%) of the pre-exposure device 10*b* is 100%. In this embodiment, the image signal is defined by 10 bit and has signal values of 0-1023. Incidentally, for example, the image signal may also be carried out by 0-255 which are defined by 8 bit, but by treating the image signal as 10 bit signals having a larger number of levels, it is possible to set parameters with high accuracy. That is, 1023 is a signal value corresponding to a density (maximum density) of a solid image of one color. Accordingly, a total amount of image data for three colors of Y, M and C is 3069 at the maximum.

Figure 13:
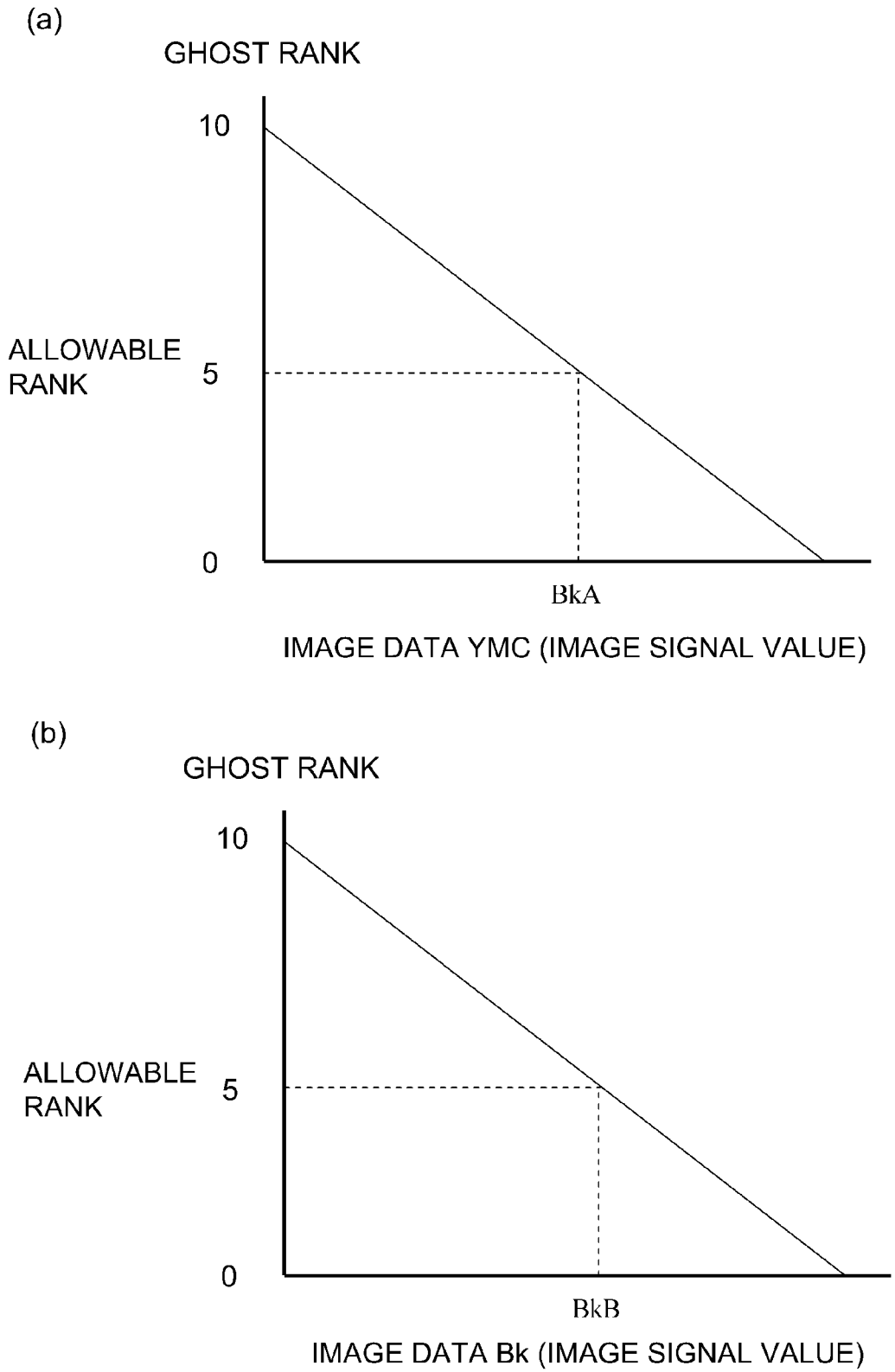
In FIG. 13, (a) is a view showing a relationship between a rank of the ghost phenomenon and image data YMC, and (b) is a view showing a relationship between the rank of the ghost phenomenon and image data Bk.

In (a) of FIG. 13, with respect to a relation property between the ghost phenomenon and the image data YMC (image signal value), a verification result thereof is shown. The ordinate is a rank of the ghost phenomenon, and the abscissa is the image data YMC.

As a result of subjective evaluation, an allowable rank is not less than 5. This is attributable to a result of observation of an image sample by a plurality of testers in an ordinary office environment.

Specifically, when the testers observe the image sample (document (text image)) and whether or not the image sample is allowable in terms of an image quality is asked to the testers, the sample discriminated as being allowable by not less than 90% of the testers is a rank 5. A rank 10 shows that the ghost phenomenon does not generate and shows that a density difference between a portion where the ghost phenomenon generates and a portion where the ghost phenomenon does not generate is 0.

On the other hand, a rank 1 is a level at which generation of the ghost phenomenon, i.e., inclusion of an abnormal image in the sample image is clearly recognized by the testers. At this time, the density difference between the portion where the ghost phenomenon generates and the portion where the ghost phenomenon does not generate is about 0.2.

The rank 5 is a level at which even when a region where the ghost phenomenon generates on the sample image is told to the testers, the testers cannot recognize the ghost phenomenon unless the testers strain their eyes. At this time, the density difference between the portion where the ghost phenomenon generates and the portion where the ghost phenomenon does not generates is about 0.02 (as measured using Xrite 504).

Thus, when the rank is not less than the rank 5, it is possible to treat the sample image as being one on which the ghost phenomenon does not generate.

Accordingly, the total amount of the signal values of the image data YMC when the allowable rank of the ghost phenomenon is the rank 5 is BkA with regard to the Bk image forming station. Specifically, in this embodiment, BkA was set at 1841.

Here, unless the Bk toner image exists at the primary transfer position in the Bk image forming station, even when the potential difference generates on the photosensitive drum 1*d*, the ghost phenomenon is not discriminated by human's eyes.

Therefore, in this embodiment, on the basis of the image data Bk together with the prepared image data YMC, ON/OFF of the pre-exposure device 10*b* is controlled. Specifically, as shown in (b) of FIG. 13, the image data Bk when a total amount of the image data Bk (image signal) is the allowable rank 5 is a threshold (BkB), and the pre-exposure device 10*b* is turned on when the image data Bk is not less than BkB and is turned off when the image data Bk is less than BkB. In other words, even when the density of the toner images which are formed in the Y, M and C image forming stations and which are superposedly transferred onto the intermediary transfer belt is not less than a predetermined density, in the case where the density of the toner image formed in the Bk image forming station is less than the predetermined density, the pre-exposure device 10*b* is turned off. On the other hand, in the case where the density of the toner image formed in the Bk image forming station is not less than the predetermined density, the pre-exposure device 10*b* is turned on.

Specifically, in this embodiment, BkB was set at 103. Incidentally, (b) of FIG. 13 shows a result in which the ghost phenomenon was verified, similarly as described above, in a condition that the image data YMC is not less than BkA.

Thus, only in the case where the image data YMC is not less than BkA and the image data Bk is not less than BkB, the pre-exposure device 10*b* is actuated.

Next, control of the pre-exposure device 10*a* of the C image forming station will be described.

In the C image forming station, the image forming stations positioned upstream of this are the Y and M image forming stations. Similarly as the Bk image forming station, on the basis of the allowable rank of the ghost phenomenon, a threshold of the total amount of the signal values of the image data YM is CA. Specifically, in this embodiment, CA was set at 1841.

Further, similarly as the Bk image forming station, on the basis of the image data C together with the prepared image data YMC, ON/OFF of the pre-exposure device 10*a* is controlled. Specifically, the total amount of the image data C (image signals) when the total amount is at the rank 5 is a threshold (CB), and the pre-exposure device 10*a* is turned on when the total amount is not less than CB and the pre-exposure device 10*a* is turned off when the total amount is less than CB. In this embodiment, CB was set at 103.

Thus, only in the case where the image data YMC is not less than CA and the image data C is not less than CB, the pre-exposure device 10*a* is actuated.

Incidentally, as regards the Y image forming station, no image forming station positioned upstream of the Y image forming station exists with respect to the movement direction of the intermediary transfer belt 7. That is, as regards the Y image forming station, the rank is not less than the allowable rank, and therefore the pre-exposure device may also be not provided. Further, in the case where the pre-exposure device is provided, also in the Y image forming station, the ON/OFF control of the pre-exposure device may also be effected so that the ghost phenomenon does not generate even in a slight degree in the case where a yellow toner amount is excessively large.

Further, as regards the M image forming station, the image forming station positioned upstream of the M image forming station, i.e., the Y image forming station exists, but only the toner image corresponding to one color of yellow exists. For that reason, the pre-exposure device may also be not provided. Incidentally, in the case where the pre-exposure device is provided, as regards the ghost phenomenon, the rank is not less than the allowable rank, but compared with the yellow, the magenta is low in brightness (lightness), and therefore, the magenta is well-grounded in that the ghost phenomenon is liable to be readily recognized. Accordingly, similarly as the Y image forming station, the ON/OFF control of the pre-exposure device may also be effected so that the ghost phenomenon does not generate even in a slight degree also with regard to the M image forming station.

(Control Sequence of Pre-Exposure Device)

Figure 14:
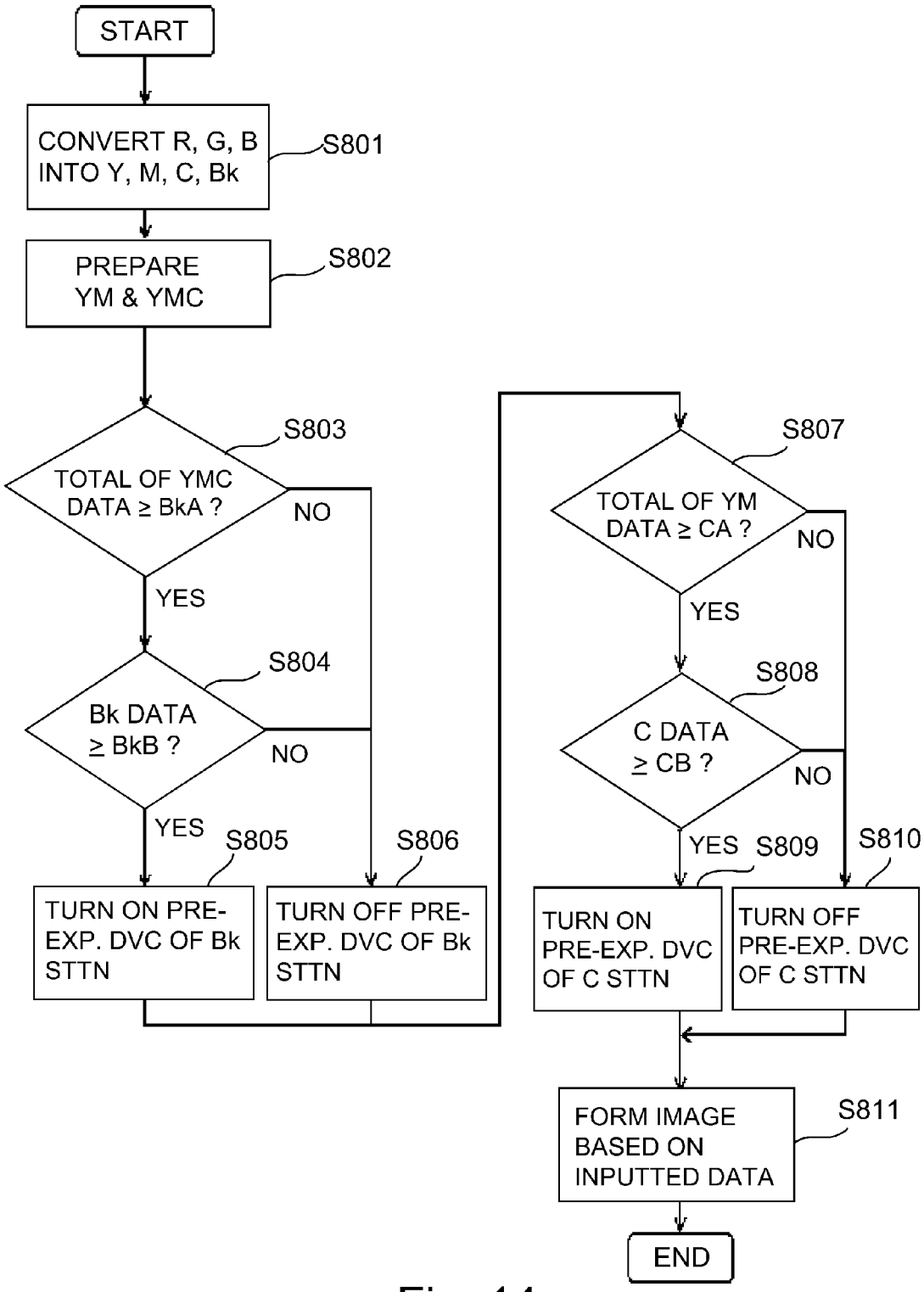
FIG. 14 is a flowchart of ON/OFF control of a pre-exposure device.

In FIG. 14, a control flow of the pre-exposure devices 10*a* and 10*b* by the controller is shown.

Inputted R, G and B image data are converted into Y, M, C and K image data (S801), and image data YM synthesized from the Y and M image data and image data YMC synthesized from the Y, M and C image data are prepared by the controller 100 (S802).

Next, the controller 100 discriminates whether or not a total amount of image signals of the image data YMC is not less than a predetermined value BkA (S803).

Here, when the total amount is not less than the predetermined value BkA, the controller further discriminates whether or not the signal value of the Bk image data is not less than BkB (S804). In S803 and S804, in the case where all is YES, the pre-exposure device 10*b* of the Bk image forming station is turned on (S805).

In S803 or S804, in the case of NO, the pre-exposure device 10*b* of the Bk image forming station is turned off (S806).

Then, the sequence goes to discrimination as to control of the pre-exposure device 10*a* of the C image forming station.

Further, the controller 100 discriminates whether or not a total amount of image signals of the image data YM is not less than a predetermined value CA (S807).

Next, when the total amount is not less than the predetermined value CA, the controller further discriminates whether or not the signal value of the C image data is not less than CB (S808). In S807 and S808, in the case where all is YES, the pre-exposure device 10*a* of the C image forming station is turned on (S809).

In S803 or S804, in the case of NO, the pre-exposure device 10*a* of the C image forming station is turned off (S810).

Finally, after the ON/OFF discrimination of the respective pre-exposure devices in S803, S804, S807 and S707, on the basis of the inputted image data, the respective color images are formed in the respective image forming stations (S811).

Incidentally, in this embodiment, BkA, BkB, CA and CB which are the thresholds are not limited to the above-described values, but may also be appropriately changed depending on a degree of recognition of the ghost phenomenon or the like.

Further, with regard to the light irradiation amount by the pre-exposure device, this amount may also be changed stepwisely depending on the image data. That is, in the case where the total amount of the image data is small, it is more suitable that the PWM duty is not set at 100% but is set at a value smaller than 100%. Specifically, not a binary control logic of ON/OFF such as non-turning on (0%) and turning-on (100%), depending on the image data, the irradiation light quantity by the pre-exposure device may also be controlled. For example, stepwise control such that when the toner amount corresponding to the image data is small, the light quantity is set at a weak light quantity (PWM duty 10%) and when the toner amount corresponding to the image data is large, the light quantity is set at a strong light quantity (PWM duty 80%) may also be executed.

Embodiment 4

Next, Embodiment 4 will be described. A basic constitution of an image forming apparatus is the same as those of Embodiment 1, and therefore, will be omitted from detailed description by adding the same reference numerals or symbols.

In Embodiment 4, a manner of computation of the image data being a trigger for the ON/OFF control of the pre-exposure device is largely different.

In Embodiments 1 to 3, the total amount of the image data is obtained by computation and this is used in the ON/OFF control of the pre-exposure device, but there is a case where the total amount of the image data is the same between the case where an entirety of an image is a half-tone image and the case where a part of the image is a solid image. In this case, if the image is the half-tone image, the above-mentioned potential difference is small and there is a possibility that the ghost phenomenon is not generated in the downstream image forming station, but if the part of the image is the solid image, the above-mentioned potential difference is large and the ghost phenomenon is caused to generate. For that reason, in the case where a discrimination criterion of the image data is the total amount, there can occur that the pre-exposure device is not turned on although the image is an image for which the pre-exposure device should be originally turned on.

Therefore, in this embodiment, in order to discriminate whether or not the above-mentioned potential difference generates, a constitution in which not only the total amount of the image data, but also whether or not a high-density pixel such as a solid image exists is discriminated is employed.

More specifically, pixels providing an image density not less than a predetermined density level (high density side) are extracted and depending on this extracted information, the ON/OFF control of the pre-exposure devices (10*a*, 10*b*) is effected. Specifically, not a total image signal of signals having a width of 0-1023 for each (one) pixel, a predetermined image density level, specifically the presence or absence of a pixel having a signal showing an image density of not less than 716 (=70% of 1023) is extracted, and is transmitted as a 1-bit signal. The pre-exposure controlling devices (20*a*, 20*b*) which received this signal control ON/OFF of the pre-exposure devices (10*a*, 10*b*).

Further, a constitution in which the number of pixels having the signal showing the image density of not less than 716 (=70% of 1023) is integrated, and on the basis of an integrated value thereof, ON/OFF of the pre-exposure devices (10*a*, 10*b*) is controlled may also be employed.

Embodiment 5

Next, Embodiment 5 will be described. A basic constitution of an image forming apparatus is the same as those of Embodiment 1, and therefore, will be omitted from detailed description by adding the same reference numerals or symbols.

In the case where a distance (corresponding to the sheet interval) between a preceding image (toner image on a first page) and its subsequent image (toner image on a second page) is shorter than a peripheral length of the photosensitive member, the preceding image (first page) has the influence on the subsequent image (second page) and constitutes a factor of generating the ghost phenomenon.

That is, whether or not the ghost phenomenon generates on the subsequent image (second page) is closely associated with the preceding image (first page).

For that reason, in this embodiment, in the case where in the ON/OFF control discrimination of the pre-exposure devices on the basis of the preceding image, the ON control discrimination is made, also with regard to the subsequent image (second page), a total amount discrimination of the image data of the image (second page) itself is not made. Then, in the case where the Bk image data (C image data) are not less than BkB (CB) which are the thresholds, the pre-exposure devices (10*a*, 10*b*) are actuated.

Figure 17:
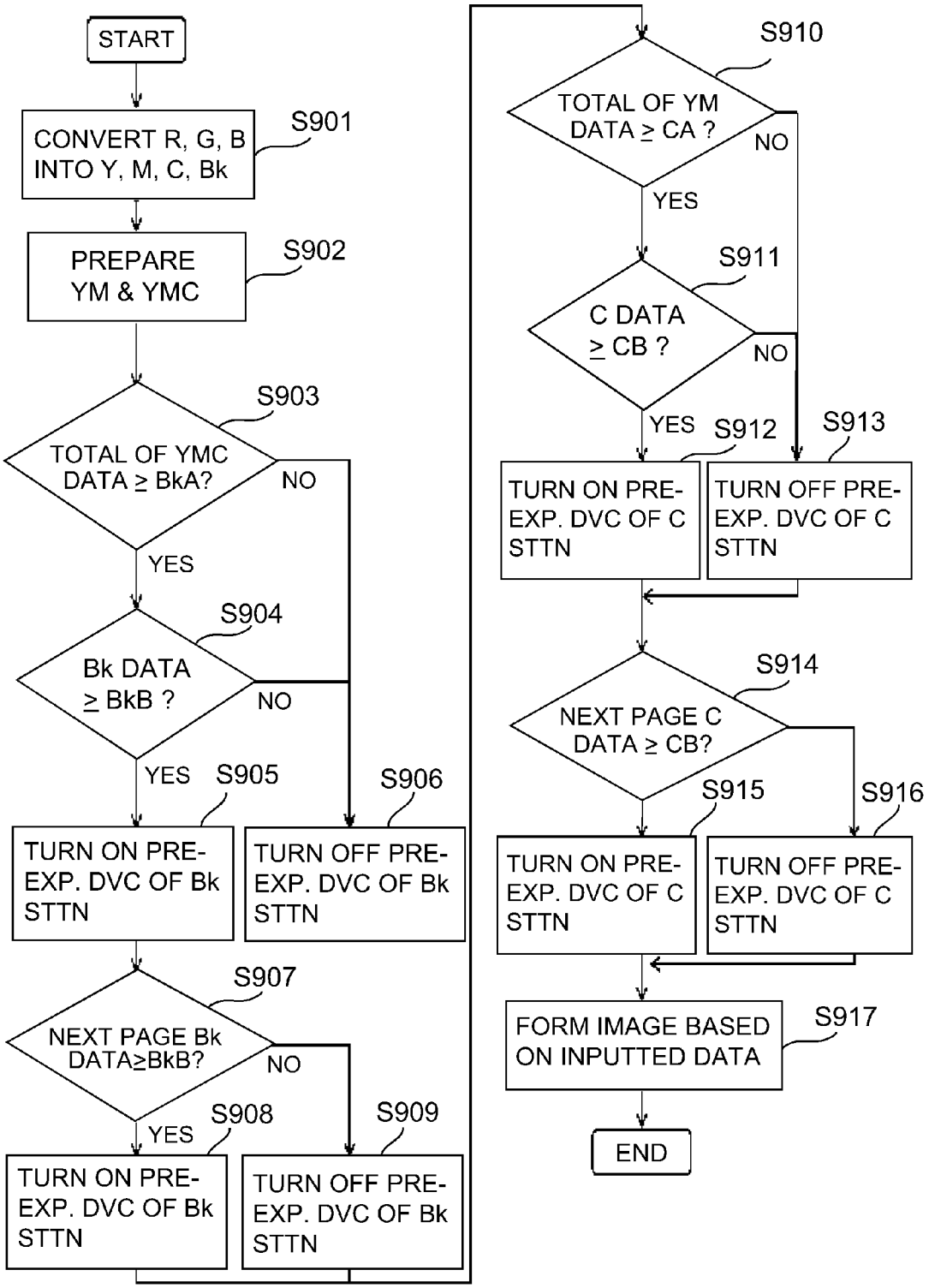
FIG. 17 is a flowchart of ON/OFF control of a pre-exposure device.

In FIG. 17, a control flow of the pre-exposure devices (10*a*, 10*b*) is shown.

A difference from the control flow (Embodiment 3) of FIG. 14 is as follows. On/OFF discrimination of the pre-exposure device (10*b*) of the Bk image forming station by S907, and S908 and S909 which are results thereof are different. Further, ON/OFF discrimination of the pre-exposure device (10*a*) of the C image forming station by S914, and S915 and S916 which are results thereof are different.

When specifically described, whether or not the Bk image data of a subsequent image (page immediately after the preceding page) is not less than BkB is discriminated (S907).

In the case where the Bk image data is not less than BkB, the pre-exposure device 10*b* of the Bk image forming station is turned on (S908). On the other hand, in the case where the Bk image data is less than BkB, the pre-exposure device 10*b* of the Bk image forming station is turned off (S909). Next, whether or not the C image data of the subsequent image (page immediately after the preceding page) is not less than CA is discriminated (S914).

In the case where the C image data is not less than CB, the pre-exposure device 10*a* of the C image forming station is turned on (S915). On the other hand, in the case where the C image data is less than CB, the pre-exposure device 10*a* of the C image forming station is turned off (S916). By the above, not only ON/OFF of the pre-exposure device is controlled on the basis of only the information of the image to be formed but also ON/OFF of the pre-exposure device is controlled also in view of the information of the subsequent image, so that it becomes possible to realize further lifetime extension of the photosensitive member while suppressing the generation of the ghost phenomenon.

In the above, the image forming apparatuses according to the present invention were described in Embodiments 1 to 3, but the present invention is not limited to such embodiments, and within the scope of ideas of the present invention, various constitutions can be replaced with other constitutions.

Figure 11:
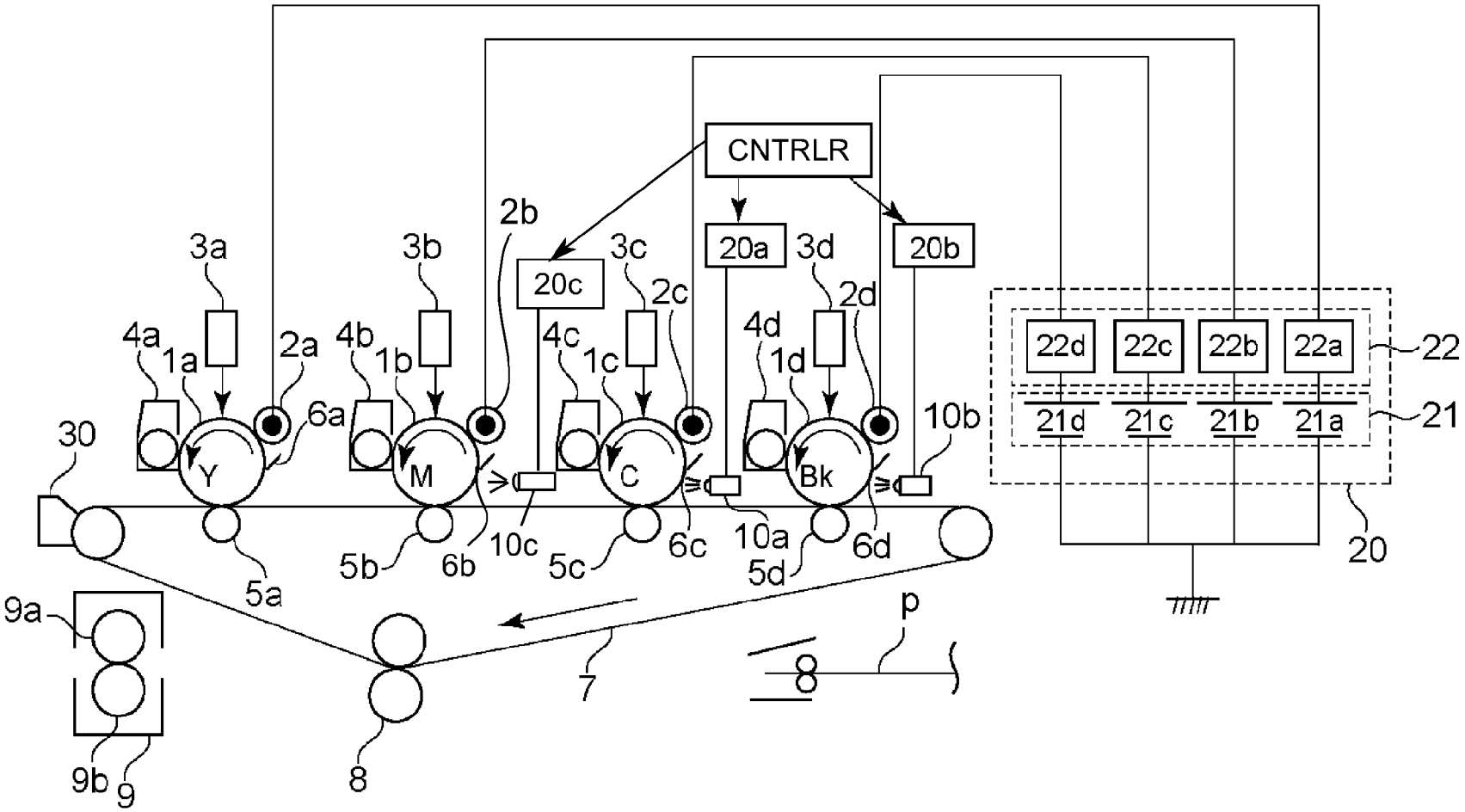
FIG. 11 is a schematic illustration of an image forming apparatus.

For example, in Embodiments 1 to 5, of the four image forming stations of Y, M, C and Bk, the constitution in which only the image forming stations of C and Bk are provided with the pre-exposure device was employed, but the present invention is not limited to such an exposure means. That is, as shown in FIG. 11, a constitution in which only the image forming stations of M, C and Bk, excluding the most upstream image forming station of the four image forming stations of Y, M, C and Bk, are provided with the pre-exposure devices may also be employed. In this case, in the case where there is a liability that the amount of the Y toner coming to the transfer position of the second image forming station of M is large and the ghost phenomenon generates in the image forming station of M similarly as in Embodiments 1 to 5, the above constitution is effective. Further, all of the four image forming stations of Y, M, C and Bk may also be provided with the pre-exposure devices.

Further, in Embodiments 1 to 5, the example in which there are four (Y, M, C, Bk) image forming stations was described, but the present invention is not limited to such an embodiment. For example, the present invention is also similarly applicable to even an embodiment in which there are three (Y, M, C) image forming stations or an embodiment in which there are five or more image forming stations.

Further, in the case of the embodiment in which there are three image forming stations Y, M and C, similarly as in the above-described Embodiments 1 to 5, on the basis of the Y image data and the M image data, ON/OFF of the pre-exposure device of the C image forming station may preferably be controlled.

Further, in the case of the embodiment in which there are five or more image forming stations, similarly as in the above-described Embodiments 1 to 5, control may only be required to be effected in the following manner. That is, ON/OFF control of the pre-exposure device in the associated image forming station may preferably be effected on the basis of the toner image (image data) formed in the image forming station positioned upstream of the associated image forming station with respect to the movement direction of the intermediary transfer belt 7.

Further, in Embodiment 2, in order to suppress the image density fluctuation due to the ON/OFF of the pre-exposure device, the applied charging bias applied to the charging device is corrected (adjusted), but the present invention is not limited only to such an embodiment. Instead thereof, the light-portion potential (VL) may also be changed by correcting (adjusting) light irradiation intensity by the exposure device. However, a potential lowering (absolute value) generates with respect to the dark-portion potential (Vd) on the photosensitive drum, and therefore as in Embodiment 2, it is further preferable that the charging bias is adjusted.

Further, in Embodiments 1 to 5, the constitution in which the charging roller which is the charging device is disposed in contact with the photosensitive member surface is employed, but the present invention is not limited thereto, and a constitution in which the charging roller is disposed near to the photosensitive member surface through a small gap may also be employed.

Further, in Embodiments 1 to 5, the constitution in which the pre-exposure devices are turned on and off on the basis of the image data was employed, but such control may also be not continued over all of periods in which the image forming apparatus is in operation.

For example, a constitution in which in a certain period, the pre-exposure devices are turned on irrespective of the image data may be employed. Specifically, the pre-exposure devices are turned on irrespective of the image data in a period from turning-on of a main switch (power source) of the image forming apparatus until images are formed on 100 sheets. Then, after a 101-th sheet and later, as in Embodiments 1 to 5, it is preferable that ON/OFF of the pre-exposure devices is controlled on the basis of the image data.

This is attributable to the following reason. As regards the lifetime lowering factor of the photosensitive member due to the light irradiation from the pre-exposure devices, in addition to the above-described reason, also a deterioration (increase) of a dark-decay amount (decay of potential in a very short time) is one factor. Thus, when the amount of the dark decay increases in the very short time, the potential of the photosensitive member charged by the electric discharge of the charging roller in an upstream gap attenuates to the extent that it is not negligible during passing through the charging nip. Thus, when the decay of the potential in the charging nip is not negligible, minute re-electric discharge partly generates in a downstream gap of the charging roller, so that there is a liability that the generation of the discharge leads to generation of potential non-uniformity. This is a problem peculiar to the case of the DC charging type.

Further, this phenomenon that the dark decay occurs in the very short time depends on a total amount of a current flowing from the charging device into the photosensitive member and a temperature in the image forming apparatus. This is because a resistance value of the undercoat layer, applied onto the surface of the aluminum-made cylinder, constituting the photosensitive member increases.

However, the increase in resistance value of the undercoat layer is reversible, and therefore, when the photosensitive member is left standing for not less than a certain time (for example, standing time in the night time), this problem is eliminated. That is, depending on a length of a stand-by time (in which the photosensitive member is not subjected to the light irradiation), the influence on the photosensitive member lifetime by the dark decay in the very short time is negligible. Accordingly, in a predetermined (initial) period from the turning-on of the main switch of the image forming apparatus, it is preferable that prevention of generation of the ghost phenomenon is prioritized by turning on the pre-exposure device.

Incidentally, without using the number of times of image formation as a trigger (100 sheets), an integrated time of light irradiation by the pre-exposure device from the turning-on of the main switch of the image forming apparatus may also be used as the trigger. Specifically, until the integrated time is 240 sec, irrespective of the image data, the pre-exposure device is turned on, and after the integrated time is 240 sec, the control is caused to go to control depending on the image data.

INDUSTRIAL APPLICABILITY

According to the present invention, there is provided an image forming apparatus capable of suppressing generation of image defect while suppressing a lowering in lifetime of the photosensitive member by the discharging means.

The invention claimed is:

1. An image forming apparatus comprising:

an image input portion into which image data corresponding to toner images to be formed is inputted;

a first image forming station including a first photosensitive member, a first charging roller configured to charge said first photosensitive member, a first exposure member configured to expose said first photosensitive member charged by said first charging roller to light on the basis of, among the image data inputted into said image input portion, first image data corresponding to a first toner image formed at said first image forming station, and a first developing device configured to develop with a toner an electrostatic latent image formed on said first photosensitive member by said first exposure member;

a second image forming station including a second photosensitive member, a second charging roller configured to charge said second photosensitive member at a charging position by being supplied with only a DC voltage, a second exposure member configured to expose said second photosensitive member charged by said second charging roller to light on the basis of, among the image data inputted into said image input portion, second image data corresponding to a second toner image formed at said second image forming station, and a second developing device configured to develop with a toner an electrostatic latent image formed on said second photosensitive member by said second exposure member;

an intermediary transfer belt configured to bear the first toner image and the second toner image which are transferred superposedly in the listed order;

a first transfer member disposed opposed to said first photosensitive member via said intermediary transfer belt and configured to electrostatically transfer the first toner image formed on said first photosensitive member onto said intermediary transfer belt;

a second transfer member disposed opposed to said second photosensitive member via said intermediary transfer belt and configured to electrostatically transfer the second toner image formed on said second photosensitive member onto said intermediary transfer belt at a transfer position;

a pre-exposure member configured to expose said second photosensitive member to light at a position downstream of the transfer position and upstream of the charging position with respect to a movement direction of said second photosensitive member; and a controller configured to control an operation of said pre-exposure member depending on only the first image data of the first image data and the second image data when image formation is effected using the first image data and the second image data.

2. An image forming apparatus according to claim 1, wherein said controller actuates said pre-exposure member when a toner amount corresponding to the first image data is not less than a predetermined amount and does not actuate said pre-exposure member when the toner amount corresponding to the first image data is less than the predetermined amount.

3. An image forming apparatus according to claim 1, wherein a voltage of an opposite polarity to a normal charge polarity of the toner is applied to said first transfer member when the first toner image is transferred from said first photosensitive member to said intermediary transfer belt and is applied to said second transfer member when the second toner image is transferred from said second photosensitive member to said intermediary transfer belt.

4. An image forming apparatus comprising:

an image input portion into which image data corresponding to toner images to be formed is inputted;

a first image forming station including a first photosensitive member, a first charging roller configured to charge said first photosensitive member, a first exposure member configured to expose said first photosensitive member charged by said first charging roller to light on the basis of, among the image data inputted into said image input portion, first image data corresponding to a first toner image formed at said first image forming station, and a first developing device configured to develop with a toner an electrostatic latent image formed on said first photosensitive member by said first exposure means member;

a second image forming station including a second photosensitive member, a second charging roller configured to charge said second photosensitive member, a second exposure member configured to expose said second photosensitive member charged by said second charging roller to light on the basis of, among the image data inputted into said image input portion, second image data corresponding to a second toner image formed at said second image forming station, and a second developing device configured to develop with a toner an electrostatic latent image formed on said second photosensitive member by said second exposure member;

a third image forming station including a third photosensitive member, a third charging roller configured to charge said third photosensitive member at a first charging position by being supplied with only a DC voltage, a third exposure member configured to expose said third photosensitive member charged by said third charging roller to light on the basis of, among the image data inputted into said image input portion, third image data corresponding to a third toner image formed at said third image forming station, and a third developing device configured to develop with a toner an electrostatic latent image formed on said third photosensitive member by said third exposure member;

a fourth image forming station including a fourth photosensitive member, a fourth charging roller configured to charge said fourth photosensitive member at a second charging position by being supplied with only a DC voltage, a fourth exposure member configured to expose said fourth photosensitive member charged by said fourth charging roller to light on the basis of, among the image data inputted into said image input portion, fourth image data corresponding to a fourth toner image formed at said fourth image forming station, and a fourth developing device configured to develop with a toner an electrostatic latent image formed on said fourth photosensitive member by said fourth exposure member;

an intermediary transfer belt configured to bear the first toner image, the second toner image, the third toner image and the fourth toner image which are transferred superposedly in the listed order;

a first transfer member disposed opposed to said first photosensitive member via said intermediary transfer belt and configured to electrostatically transfer the first toner image formed on said first photosensitive member onto said intermediary transfer belt;

a second transfer member disposed opposed to said second photosensitive member via said intermediary transfer belt and configured to electrostatically transfer the second toner image formed on said second photosensitive member onto said intermediary transfer belt;

a third transfer member disposed opposed to said third photosensitive member via said intermediary transfer belt and configured to electrostatically transfer the third toner image formed on said second photosensitive member onto said intermediary transfer belt at a first transfer position;

a fourth transfer member disposed opposed to said fourth photosensitive member via said intermediary transfer belt and configured to electrostatically transfer the fourth toner image formed on said fourth photosensitive member onto said intermediary transfer belt at a second transfer position;

a first pre-exposure member configured to expose said third photosensitive member to light at a position downstream of the first transfer position and upstream of the first charging position with respect to a movement direction of said third photosensitive member;

a second pre-exposure member configured to expose said fourth photosensitive member to light at a position downstream of the second transfer position and upstream of the second charging position with respect to a movement direction of said fourth photosensitive member; and a controller configured to control an operation of said first pre-exposure member on the basis of only the first image data and the second image data of the first to fourth image data and configured to control an operation of said second pre-exposure member on the basis of only the first image data, the second image data and the third image data of the first to fourth image data when image formation is effected using the first image data, the second image data, the third image data and the fourth image data.

5. An image forming apparatus according to claim 4, wherein said controller actuates said first pre-exposure member when a sum of a toner amount corresponding to the first image data and a toner amount corresponding to the second image data is not less than a predetermined amount and does not actuate said first pre-exposure member when the sum is less than the predetermined amount.

6. An image forming apparatus according to claim 4, wherein said controller actuates said second pre-exposure member when a sum of a toner amount corresponding to the first image data, a toner amount corresponding to the second image data and a toner amount corresponding to the third image data is not less than a predetermined amount and does not actuate said second pre-exposure member when the sum is less than the predetermined amount.

7. An image forming apparatus according to claim 4, wherein a voltage of an opposite polarity to a normal charge polarity of the toner is applied to said first to fourth transfer members when the first to fourth toner images are transferred to said intermediary transfer belt, respectively.

8. An image forming apparatus comprising:

an image input portion into which image data corresponding to toner images to be formed is inputted;

a first image forming station including a first photosensitive member, a first charging roller configured to charge said first photosensitive member, a first exposure member configured to expose said first photosensitive member charged by said first charging roller to light on the basis of, among the image data inputted into said image input portion, first image data corresponding to a first toner image formed at said first image forming station, and a first developing device configured to develop with a toner an electrostatic latent image formed on said first photosensitive member by said first exposure member;

a second image forming station including a second photosensitive member, a second charging roller configured to charge said second photosensitive member at a first charging position by being supplied with only a DC voltage, a second exposure member configured to expose said second photosensitive member charged by said second charging roller to light on the basis of, among the image data inputted into said image input portion, second image data corresponding to a second toner image formed at said second image forming station, and a second developing device configured to develop with a toner an electrostatic latent image formed on said second photosensitive member by said second exposure member;

a third image forming station including a third photosensitive member, a third charging roller configured to charge said third photosensitive member at a second charging position by being supplied with only a DC voltage, a third exposure member configured to expose said third photosensitive member charged by said third charging roller to light on the basis of, among the image data inputted into said image input portion, third image data corresponding to a third toner image formed at said third image forming station, and a third developing device configured to develop with a toner an electrostatic latent image formed on said third photosensitive member by said third exposure member;

a fourth image forming station including a fourth photosensitive member, a fourth charging roller configured to charge said fourth photosensitive member at a third charging position by being supplied with only a DC voltage, a fourth exposure member configured to expose said fourth photosensitive member charged by said fourth charging roller to light on the basis of, among the image data inputted into said image input portion, fourth image data corresponding to a fourth toner image formed at said fourth image forming station, and a fourth developing device configured to develop with a toner an electrostatic latent image formed on said fourth photosensitive member by said fourth exposure member;

an intermediary transfer belt configured to bear the first toner image, the second toner image, the third toner image and the fourth toner image which are transferred superposedly in the listed order;

a first transfer member disposed opposed to said first photosensitive member via said intermediary transfer belt and configured to electrostatically transfer the first toner image formed on said first photosensitive member onto said intermediary transfer belt;

a second transfer member disposed opposed to said second photosensitive member via said intermediary transfer belt and configured to electrostatically transfer the second toner image formed on said second photosensitive member onto said intermediary transfer belt at a first transfer position;

a third transfer member disposed opposed to said third photosensitive member via said intermediary transfer belt and configured to electrostatically transfer the third toner image formed on said second photosensitive member onto said intermediary transfer belt at a second transfer position;

a fourth transfer member disposed opposed to said fourth photosensitive member via said intermediary transfer belt and configured to electrostatically transfer the fourth toner image formed on said fourth photosensitive member onto said intermediary transfer belt at a third transfer position;

a first pre-exposure member configured to expose said second photosensitive member to light at a position downstream of the first transfer position and upstream of the first charging position with respect to a movement direction of said third photosensitive member;

a second pre-exposure member configured to expose said third photosensitive member to light at a position downstream of the second transfer position and upstream of the second charging position with respect to a movement direction of said third photosensitive member;

a third pre-exposure member configured to expose said fourth photosensitive member to light at a position downstream of the third transfer position and upstream of the third charging position with respect to a movement direction of said fourth photosensitive member; and a controller configured to control an operation of said first pre-exposure member on the basis of only the first image data of the first to fourth image data, configured to control an operation of said second pre-exposure member on the basis of only the first image data and the second image data of the first to fourth image data, and configured to control an operation of said third pre-exposure member on the basis of only the first image data, the second image data and the third image data of the first to fourth image data when image formation is effected using the first image data, the second image data, the third image data and the fourth image data.

9. An image forming apparatus according to claim 8, wherein said controller actuates said second pre-exposure member when a sum of a toner amount corresponding to the first image data and a toner amount corresponding to the second image data is not less than a predetermined amount and does not actuate said second pre-exposure member when the sum is less than the predetermined amount.

10. An image forming apparatus according to claim 8, wherein said controller actuates said third pre-exposure member when a sum of a toner amount corresponding to the first image data, a toner amount corresponding to the second image data and a toner amount corresponding to the third image data is not less than a predetermined amount and does not actuate said third pre-exposure member when the sum is less than the predetermined amount.

11. An image forming apparatus according to claim 8, wherein a voltage of an opposite polarity to a normal charge polarity of the toner is applied to said first to fourth transfer members when the first to fourth toner images are transferred to said intermediary transfer belt, respectively.

* * * * *